US005460923A

United States Patent [19]

Goto et al.

[11] Patent Number: 5,460,923

[45] Date of Patent: Oct. 24, 1995

[54] PROCESSING METHOD FOR SILVER HALIDE PHOTOGRAPHIC MATERIAL

[75] Inventors: Masatoshi Goto; Yoshihiro Fujita, both of Kanagawa, Japan

[73] Assignee: Fuji Photo Film Co., Ltd., Kanagawa, Japan

[21] Appl. No.: 362,929

[22] Filed: Dec. 23, 1994

[30] Foreign Application Priority Data

Dec. 24, 1993 [JP] Japan ..... 5-345971

[51] Int. Cl.[6] ..... G03C 7/42

[52] U.S. Cl. ..... 430/390; 430/393; 430/455; 430/456; 430/457; 430/459; 430/460

[58] Field of Search ..... 430/390, 393, 430/419, 453, 455, 456, 457, 459, 460

[56] References Cited

U.S. PATENT DOCUMENTS 5,039,599 8/1991 Ueda ..... 430/393

FOREIGN PATENT DOCUMENTS 1231051 9/1989 Japan ..... 430/460

*Primary Examiner*—Hoa Van Le

*Attorney, Agent, or Firm*—Sughrue, Mion, Zinn, Macpeak & Seas

[57] ABSTRACT

A processing method for silver halide photographic material is disclosed, in which at least one hydrophilic colloidal layer containing a dye of a solid fine grain dispersion. The processing method is carried out by processing the photographic material with a solution having a fixing ability containing at least one compound represented by formula (A):

$$RSO_2SM \qquad (A)$$

wherein R represents an aliphatic group, an aryl group or a heterocyclic group, and M represents a hydrogen atom or a cation group.

13 Claims, No Drawings

PROCESSING METHOD FOR SILVER HALIDE PHOTOGRAPHIC MATERIAL

FIELD OF THE INVENTION

The present invention relates to a processing method for silver halide photographic materials and, more particularly, to a processing method capable of rapid processing silver halide photographic materials.

BACKGROUND OF THE INVENTION

Processing of silver halide photographic materials, in general, comprises a development step and a desilvering step. In the processing of color photographic materials, during the desilvering step, a developed silver which has been formed in the color development step is oxidized (bleached) with a bleaching agent having an oxidizing ability to form a silver salt, and is removed from the light-sensitive layer by a fixing agent to form a soluble silver together with an unused silver halide (fixing).

There are two cases where bleaching and fixing are carried out, one is independently carried out in a bleaching step and a fixing step, the other is carried out simultaneously in a bleach-fixing in one step. Details of these processing steps are described in James, *The theory of Photographic Process,* 4th Edition (1977).

The above processing steps are generally carried out using an automatic processor. With the recent increase of a small in-store processing service systems known as mini-labs, rapid services for customers have been widely spread.

A work load for these mini-labs is large in, such as the preparation of processing solutions or waste disposal, therefore, it has been desired to reduce an amount of used processing solutions, that is, lower amount of replenishers.

Under the circumstances, there has recently been a great demand particularly for a rapid processing and a reduction of replenishing; and a reduction of replenishing in the bleaching, fixing and bleach-fixing steps, as well as processing with rapidity are also strongly desired.

Thiosulfate compounds have been conventionally widely used as a fixing agent in the fixing step, but various other fixing agents have been investigated. For example, mesoionic compounds disclosed in JP-A-4-143755 and JP-A-4-143756 (the term "JP-A" as used herein refers to a "published unexamined Japanese patent application"), compounds such as 3,6-dithia-1,8-octanediol, ethylene-bis(thioglycolic acid), and thiocyanic acid disclosed in Haist, *Modern Photographic Processing*, Vol. 2 (1979), pages 580 to 584, as a fixing agent or a fixing accelerator were proposed.

However, these compound have not practically been used due to an insufficient fixing speed, an unacceptable solubility, or a problem in safety.

A reduction in a fixing speed or an increase in a minimum cyan density (cyan stain) have been encountered due to an effect of a silver ion or a halogen ion, dissolved from a photographic material, particularly when a replenishing rate of a fixing solution is low. Thus, a reduced replenishment and a rapid processing are considered as being difficult to be compatible with.

In recent years, reducing ammonium ions from the processing solution having a fixing ability has been proposed from the viewpoint of environmental conservation, however, such a processing solution causes problems lowering the processing speed and increasing the cyan stain as well.

SUMMARY OF THE INVENTION

An object of the present invention is to provide a processing method for a silver halide photographic material which is excellent in a fixing ability.

Another object of the present invention is to provide a processing method for a silver halide photographic material which is capable of reducing a cyan stain which is increased during continuous processing.

A further object of the present invention is to provide a processing method for a silver halide photographic material which is excellent in a fixing ability even when an ammonium ion is reduced.

The above objects have been attained by the following processing method.

(1) A processing method for a silver halide photographic material (hereinafter sometimes referred to as merely a photographic material) comprising processing a photographic material using the processing solution having a fixing ability, wherein said photographic material has at least one hydrophilic colloidal layer containing a solid fine grain dispersion of a dye and the processing solution having a fixing ability contains at least one kind of a compound represented by formula (A):

$$RSO_2SM \qquad (A)$$

wherein R represents an aliphatic group, an aryl group or a heterocyclic group, and M represents a hydrogen atom or a cationic group.

(2) The processing method for a silver halide photographic material as described in (1), wherein said dye is a compound represented by the following formula (I):

$$D—(X)_y \qquad (Z)$$

wherein D represents a compound having a chromophore, X represents a dissociative proton bonded to D directly or via a divalent linking group, or a group having a dissociative proton, and y represents an integer of from 1 to 7.

(3) The processing method for a silver halide photographic material as described in (1) or (2), wherein the ammonium ion concentration in said processing solution having a fixing ability is from 0 to 50 mol % based on the whole cation.

DETAILED DESCRIPTIONS OF THE INVENTION

The processing solution having a fixing ability of the present invention specifically means a fixing solution, a bleach-fixing solution, and a fix-stabilizing solution, and preferably, a fixing solution and a bleach-fixing solution.

Formula (A) of the present invention is described in detail below.

In formula (A), an aliphatic group represented by R is an aliphatic group preferably having from 1 to 30 carbon atoms, and particularly preferably a straight chain, a branched, or a cyclic group, which include an alkyl, alkenyl, alkynyl, aralkyl group having from 1 to 20 carbon atoms, e.g., a methyl group, an ethyl group, an isopropyl group, a t-butyl group, an n-octyl group, an n-decyl group, n-hexadecyl group, a cyclopropyl group, a cyclopentyl group, a cyclohexyl group, an allyl group, a 2-butenyl group, a 3-pentenyl group, a propargyl group, a 3-pentynyl group, a benzyl group, etc.

In formula (A), an aryl group represented by R is an aryl group preferably having from 6 to 30 carbon atoms, and particularly preferably a monocyclic or a condensed aryl group having from 6 to 20 carbon atoms, e.g., a phenyl group, a naphthyl group, etc.

In formula (A), a heterocyclic group represented by R is a 3- to 10-membered saturated or unsaturated heterocyclic group containing at least one of a nitrogen atom, an oxygen atom and a sulfur atom. It may be a monocyclic or may be condensed with other aromatic ring to form a ring. The preferred heterocyclic group is a 5- or 6-membered aromatic heterocyclic ring, e.g., a pyridyl group, an imidazolyl group, a quinolyl group, a benzimidazolyl group, a pyrimidyl group, a pyrazolyl group, an isoquinolynyl group, a thiazolyl group, a thienyl group, a furyl group, a benzothiazolyl group, etc.

Also, in formula (A), each of the groups represented by R may be substituted. Examples of substituents include a halogen atom (e.g., a fluorine atom, a chlorine atom, a bromine atom, etc.), an alkyl group (e.g., a methyl group, an ethyl group, an n-propyl group, an isopropyl group, a t-butyl group, an n-octyl group, a cyclopentyl group, a cyclohexyl group, etc.), an alkenyl group (e.g., an allyl group, a 2-butenyl group, a 3-pentenyl group, etc.), an alkynyl group (e.g., a propargyl group, a 3-pentynyl group, etc.), an aralkyl group (e.g., a benzyl group, a phenethyl group, etc.), an aryl group (e.g., a phenyl group, a naphthyl group, a 4-methylphenyl group, etc.), a heterocyclic group (e.g., a pyridyl group, a furyl group, an imidazolyl group, a piperidyl group, a morpholino group, etc.), an alkoxy group (e.g., a methoxy group, an ethoxy group, a butoxy group, etc.), an aryloxy group (e.g., a phenoxy group, a 2-naphthyloxy group, etc.), an amino group (e.g., an unsubstituted amino group, a dimethylamino group, an ethylamino group, an anilino group, etc.), an acylamino group (e.g., an acetylamino group, a benzoylamino group, etc.), a ureido group (e.g., an unsubstituted ureido group, an N-methylureido group, an N-phenylureido group, etc.), a urethane group (e.g., a methoxycarbonylamino group, a phenoxycarbonylamino group, etc.), a sulfonylamino group (e.g., a methylsulfonylamino group, a phenylsulfonylamino group, etc.), a sulfamoyl group (e.g., an unsubstituted sulfamoyl group, an N,N-dimethylsulfamoyl group, an N-phenylsulfamoyl group, etc.), a carbamoyl group (e.g., an unsubstituted carbamoyl group, an N,N-diethylcarbamoyl group, an N-phenylcarbamoyl group, etc.), a sulfonyl group (e.g., a mesyl group, a tosyl group, etc.), a sulfinyl group (e.g., a methylsulfinyl group, a phenylsulfinyl group, etc.), an alkyloxycarbonyl group (e.g., a methoxycarbonyl group, an ethoxycarbonyl group, etc.), an aryloxycarbonyl group (e.g., a phenoxycarbonyl group, etc.), an acyl group (e.g., an acetyl group, a benzoyl group, a formyl group, a pivaloyl group, etc.), an acyloxy group (e.g., an acetoxy group, a benzoyloxy group, etc.), a phosphoric acid amide group (e.g., N,N-diethyl phosphoric acid amide group, etc.), an alkylthio group (e.g., a methylthio group, an ethylthio group, etc.), an arylthio group (e.g., a phenylthio group, etc.), a cyano group, a sulfo group, a thiosulfonyl group, a carboxy group, a hydroxy group, a mercapto group, a phosphono group, a nitro group, a sulfino group, an ammonio group (e.g., a trimethylammonio group), a phosphonio group, and a hydrazino group. These groups may further be substituted. When there are two or more substituents, they may be the same or different. Preferred substituents include an unsubstituted amino group, a carboxy group, a halogen atom, an alkyl group, a thiosulfonyl group, an ammonio group, a hydroxy group, and an aryl group.

In formula (A), the cationic group represented by M includes an alkali metal ion (e.g., a sodium ion, a potassium ion, a lithium ion, and a cesium ion), an alkaline earth metal ion (e.g., a calcium ion, a magnesium ion), an ammonium group (e.g., an unsubstituted ammonium group, a methylammonium group, a trimethylammonium group, a tetramethylammonium group, a dimethylbenzylammonium group), and a guanidinium group.

In formula (A), more preferably, R represents an aliphatic group and a heterocyclic group, and M represents a hydrogen atom, an alkali metal ion or an ammonium group.

In formula (A), further preferably, R represents an aliphatic group having from 1 to 6 carbon atoms, and M represents a sodium ion, a potassium ion, or an unsubstituted ammonium group.

In formula (A), most preferably, R represents an alkyl group having from 1 to 6 carbon atoms, and M represents a sodium ion or a potassium ion.

Specific examples of the compounds of the present invention are shown below, but they are not limited thereto.

1. $CH_3SO_2SNH_4$
2. $CH_3SO_2SNa$
3. $CH_3SO_2SK$
4. $C_2H_5SO_2SNH_4$
5. $C_2H_5SO_2SNa$
6. $H_2NCH_2CH_2SO_2SNH_4$
7. $H_2NCH_2CH_2SO_2SNa$
8. $H_3\overset{+}{N}CH_2CH_2SO_2S^-$
9. $HOCH_2CH_2SO_2SNa$
10. $HOCH_2CH_2SO_2SNH_4$
11. $HOOCCH_2CH_2SO_2SNa$
12. $H_4NOOCCH_2CH_2SO_2SNH_4$
13. $ClCH_2CH_2SO_2SNa$
14. $NaSSO_2CH_2CH_2SO_2SNa$
15. $H_2N\overset{\overset{\displaystyle NH}{\|}}{C}NHCH_2CH_2SO_2SH$
16. $CH_3\overset{\overset{\displaystyle OH}{|}}{C}HSO_2SK$
17. $CH_3\overset{\overset{\displaystyle OH}{|}}{C}HSO_2SNH_4$
18. $HOOC-\overset{\overset{\displaystyle NH_2}{|}}{C}HCH_2SO_2SNa$
19. 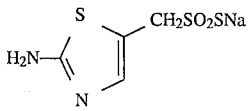
20. $CH_3SO_2Li$
21. $HOOC\overset{\overset{\displaystyle NH_2}{|}}{C}HCH_2SO_2SNH_4$
22. $CH_3SO_2S^-\overset{+}{N}(CH_3)_4$
23. $CH_3-\overset{\overset{\displaystyle CH_3}{|}}{\underset{\underset{\displaystyle CH_3}{|}}{N^+}}CH_2CH_2SO_2S^-$ -continued 24. $H_2NCH_2CH_2\overset{NH_2}{\overset{|}{C}}HCH_2SO_2SH$ 25. 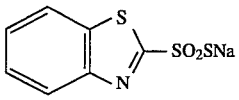

26. 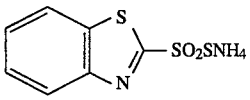

27. $C_3H_7SO_2SNH_4$
28. $C_3H_7SO_2SNa$
29. $C_4H_9SO_2SNH_4$
30. $C_6H_{13}SO_2SNa$

31. 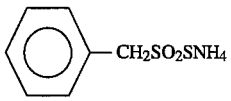

32. 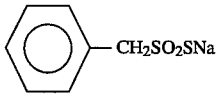

33. 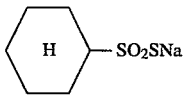

34. 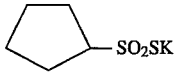

35. 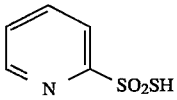

36. 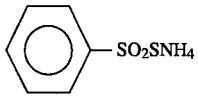

37. 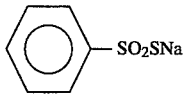

38. 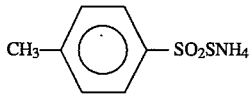

39. 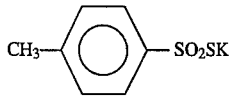

40. $CH_3CH(CH_3)CH_2SO_2SNa$

41. 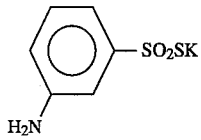

-continued

42. 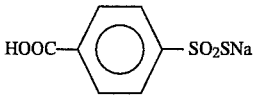

43. 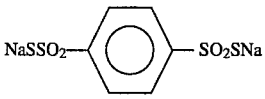

44. $CH_2=CHCH_2SO_2SNa$

The compounds represented by formula (A) of the present invention are prior known and can be synthesized by reacting a sulfonyl chloride compound with a sulfide such as an alkali metal sulfide or an ammonium sulfide, or reacting a sulfinic acid compound with a sulfur. For example, synthesis examples disclosed in *J. Anal. Chem., USSR*, Vol. 20, 1701 (1950) and German patent 840,693 (1952) are referred to.

The compound represented by formula (A) of the present invention are used in an amount of generally from $1\times10^{-3}$ to 5 mol/liter, preferably from $5\times10^{-3}$ to 3 mol/liter, and more preferably from $1\times10^{-2}$ to 1 mol/liter, of the processing solution having a fixing ability (hereinafter sometimes referred to as the fixable solution). When the addition amount is small, the fixing acceleration effect and the preventing effect of the cyan stain increase are reduced, on the other hand, when the addition amount is too large, the deposition of the fixing solution is liable to occur when stored at a low temperature.

The compound represented by formula (A) of the present invention may be used alone, but when used in combination with the conventional fixing agents, the efficiency is more remarkable.

The fixing agents which are used in combination with the compound represented by formula (A) include, for example, thiosulfate such as sodium thiosulfate, ammonium thiosulfate, ammonium sodium thiosulfate, and potassium thiosulfate; thiocyanate (rhodanide) such as sodium thiocyanate, ammonium thiocyanate, and potassium thiocyanate; thiourea compounds, thioether compounds, mercapto compounds, and mesoionic compounds. Thiosulfate is preferred and sodium thiosulfate is particularly preferred of them. The preferred addition amount of thiosulfate is from 0.1 to 3 mol, more preferably from 0.5 to 1.5 mol, per liter of the fixable solution.

The effect of the present invention is remarkable when an alkali metal ion concentration in the fixing ability solution is from 0.5 to 8 g ion/liter, preferably from 1 to 6 g ion/liter, and particularly preferably from 1.5 to 4 g ion/liter.

The effect of the present invention is also remarkable when the ammonium ion concentration in the fixable solution is small. Ammonium ion concentration is preferably from 0 to 1 g ion/liter, more preferably from 0 to 0.5 g ion/liter, and most preferably from 0 to 0.1 g ion/liter.

The compound represented by formula (A) of the present invention may be used in combination with a fixing accelerator or a fixing agent, which includes, for example, ammonium thiocyanate (ammonium rhodanide), thiourea, and thioether (e.g., 3,6-dithia-1,8-octanediol). The amount of these compounds used in combination is from 0.01 to 1 mol, preferably from 0.1 to 0.5 mol, per liter of the fixable solution.

The fixable solution may contain preservatives such as sulfite (e.g., sodium sulfite, potassium sulfite, ammonium sulfite), hydroxylamines, hydrazines, bisulfite addition product of aldehyde compounds (e.g., acetaldehyde-sodium bisulfite), or sulfinic acid compounds disclosed in the specification of JP-A-1-231051. Moreover, various kinds of a brightening agent, a defoaming agent, a surfactant, and an organic solvent such as polyvinylpyrrolidone or methanol can be included.

Further, it is preferred for the fixable solution to contain a chelating agent for the purpose of stabilization of the processing solution such as various kinds of aminopolycarboxylic acids, or organic phosphonic acids. Preferred chelating agents include, for example, aminopolycarboxylic acid such as nitrilotriacetic acid, hydroxyethyliminodiacetic acid, nitriloacetate dipropionic acid, ethylenediaminetetraacetic acid, diethylenetriaminepentaacetic acid, cyclohexanediaminetetraacetic acid, 1,2-propylenediaminetetraacetic acid, ethylenediaminedisuccinic acid, and 1,3-propylenediaminedisuccinic acid. The addition amount of the chelating agent is generally from 0.01 to 0.3 mol, and preferably from 0.03 to 0.2 mol, per liter of the processing solution.

The bleach-fixing processing may be carried out before or after the fixing processing in the present invention.

The bleach-fixing solution can contain the compounds which can be conducted in the fixing solution or the bleaching solution described later.

The bleach-fixing solution at the start of the processings (starting solution) is prepared by dissolving the compounds which are used in the bleach-fixing solution in water, alternatively, may be prepared by mixing the bleaching solution and the fixing solution separately prepared in appropriate amounts.

A pH of the fixing solution for photographic materials is preferably in the range of from 5 to 9, and more preferably from 6 to 7.5. The pH of the bleach-fixing solution is preferably in the range of from 5.5 to 8.0, and more preferably from 6.0 to 7.5.

It is preferred to include compounds having a pKa value in the range of from 6.0 to 9.0 as a buffering agent for adjusting the pH of the fixing solution and the bleach-fixing solution in the above ranges and also for improving the stabilization of the processing solutions. Examples of these compounds are, for example, phosphate, imidazoles such as imidazole, 1-methylimidazole, 2-methylimidazole, 1-ethylimidazole, triethanolamine, N-allylmorpholine, and N-benzoylpiperazine, and imidazole compounds are most preferred of them. Preferred imidazole compounds are those disclosed in JP-A-4-130432, represented by formula (I), specific examples are imidazole compounds (1) to (12) in the above patent specification, and most preferred of them are imidazole and 2-methylimidazole.

These compounds are used preferably in an amount of from 0.01 to 2 mol, more preferably from 0.05 to 0.5 mol, per liter of the fixing ability solution.

When a silver ion or a halogen ion (in particular, an iodine ion) accumulates by processing in a reduced amount replenishing of particularly the fixable solution, the effect of the present invention is remarkable for improving the fixing ability and preventing the increase of the cyan stain.

It is preferred to introduce a washing water or a stabilizing solution of the successive baths into the fixing solution in addition to a fixing replenisher. In this case, the over-flow of the processing solutions of the successive baths may be introduced into the fixing bath partially or entirely, or the processing solutions of the processing baths may be directly introduced into the fixing bath by means of a pump.

On adopting a replenishing system, all the replenishing amount of the fixing solution (inclusive of the amount of the washing water or the stabilizing solution if the washing water or the stabilizing solution are introduced into the fixing bath) is preferably from 100 to 2,000 ml, more preferably from 100 to 800 ml, and most preferably from 100 to 500 ml, per $m^2$ of the photographic material. The less the replenishing amount, the more remarkable is the effect of the present invention.

A total processing time for the fixable processing according to the present invention is generally from 0.5 to 4 minutes, preferably from 0.5 to 2 minutes, and particularly preferably from 0.5 to 1 minute.

A total processing time for the desilvering step of the present invention, comprising the bleaching step, the bleach-fixing step, and the fixing step, is preferably from 45 seconds to 4 minutes, and more preferably from 1 minute to 2 minutes, at a processing temperature of from 25° C. to 50° C. and preferably from 35° C. to 45° C.

Silver recovery from the fixing solution of the present invention can be carried out by known methods, and the regenerated solution after the silver recovery can be used in the present invention. Preferred methods of the silver recovery include an electrolysis method (disclosed in French Patent 2,299,667), a precipitation method (disclosed in JP-A-52-73037 and German Patent 2,331,220), an ion exchange method (disclosed in JP-A-51-171114 and German Patent 2,548,237), and a metal substitution method (disclosed in British Patent 1,353,805). It is preferred to conduct these silver recovery methods by an in-line system from a tank solution to further improve the rapid processability.

A water washing processing step is generally carried out after a fixing processing step. A simple method which comprises stabilization processing after processing with a fixing solution without a substantial water washing step can be employed.

The photographic material of the present invention can be carried out in a development process using a conventional method disclosed in Research Disclosure, No. 17643, pages 28 and 29, ibid., No. 18716, page 651, from the left column to the right column, and ibid., No. 307105, pages 880 and 881.

The color developing solution to be used for the development processing of photographic materials of the present invention is preferably an aqueous alkaline solution comprising an aromatic primary amine color developing agent as a main component. Those preferred as such a color developing agent are p-phenylenediamine compounds, although aminophenol compounds are also useful. Specific examples of p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl)aniline,4-amino-3-methyl-N-ethyl-N-(3-hydroxypropyl)aniline,4-amino-3-methyl-N-ethyl-N-(2-hydroxypropyl)aniline,4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, and sulfates, hydrochlorides, or p-toluenesulfonates of the above compounds. In particular, 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and hydrochlorides, p-toluenesulfonates and sulfates of the above compounds are preferred of them. These compounds can also be used as a mixture of two or more thereof.

An amount used of the aromatic primary amine developing agent is preferably from 0.0002 mol to 0.2 mol and more preferably from 0.001 mol to 0.1 mol, per liter of the color developing solution.

The color developing solution generally contains a pH buffering agent such as an alkali metal of carbonate, borate, or phosphate, and 5-sulfosalicylate, a development inhibitor or an antifoggant such as a chloride, a bromide, an iodide, benzimidazoles, benzothiazoles, or a mercapto compound. In addition, the color developing solution may contain various kinds of preservatives, according to the necessity, for example, hydroxylamine, diethylhydroxylamine, hydroxylamines represented by formula (I) in JP-A-3-144446, sulfite, hydrazines such as N,N-biscarboxymethylhydrazine, phenylsemicarbazides, triethanolamine, and catechol sulfonic acids and so on; an organic solvent such as ethylene glycol, and diethylene glycol; a development accelerator such as benzyl alcohol, polyethylene glycol, quaternary ammonium salt, and amines; a dye forming coupler; a competitive coupler; an auxiliary developing agent such as 1-phenyl-3-pyrazolidone; a tackifier; various kinds of chelating agents represented by aminopolycarboxylic acid, aminopolyphosphonic acid, alkylsulfonic acid, and phosphonocarboxylic acid, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts thereof.

Among the foregoing compounds, a substituted hydroxylamine is the most preferred as a preservative, and those having substituents such as alkyl groups substituted with a water-soluble groups, e.g., a sulfo group, a carboxyl group, or a hydroxyl group are most preferred. Most preferred examples are N,N-bis(2-sulfoethyl)hydroxylamines and alkali metal salts thereof.

A compound having a biodegradability is preferred as a chelating agent. Examples of such chelating agents are disclosed in JP-A-63-146998, JP-A-63-199295, JP-A-63-267750, JP-A-63-267751, JP-A-2-229146, JP-A-3-186841, German Patent 3,739,610, EP 468325, etc.

It is preferred that the processing solutions in the replenisher tank or the processing tank of a color developing solution are shielded with a liquid such as a high boiling point organic solvent to reduce the contact area with air. Liquid paraffin is the most preferred as a liquid shielding agent and is particularly preferred to be contained in a replenisher.

A processing temperature of the color developing solution used in the present invention is generally from 20° C. to 55° C. and preferably from 30° C. to 55° C. A processing time is generally from 20 seconds to 8 minutes, preferably from 30 seconds to 5 minutes, and more preferably from 1 minute to 3 minutes and 20 seconds when the photographic material contains a silver iodide as a silver halide, and is generally from 10 seconds to 1 minute and 20 seconds, preferably from 10 seconds to 60 seconds, and more preferably from 10 seconds to 40 seconds when the photographic material does not contain a silver iodide as a silver halide.

In the case where a reversal processing is carried out, a black-and-white development is performed, in general, prior to a color development. Known black-and-white developing agents, such as dihydroxybenzenes, e.g., hydroquinone, 3-pyrazolidones, e.g., 1-phenyl-3-pyrazolidone, or aminophenols, e.g., N-methyl-p-aminophenol, can be used alone or in combination in a black-and-white developing solution.

A pH of such a color developing solution and a black-and-white developing solution ranges generally from 9 to 12. The amount of the developing solution to be replenished is generally 3 liters or less per $m^2$ of the photographic material, although it varies depending on the kind of the color photographic materials to be processed. Also, it is possible to reduce the amount of the replenisher to 500 ml or less by lowering the concentration of the bromine ion in the replenisher. It is preferred to reduce the contact area of air with the developing solution in a processing tank to prevent evaporation and aerial oxidation of the developing solution in the case of reducing the amount of a replenisher used.

The contact area of a photographic processing solution in a processing tank with air can be represented by opening ratio defined below.

$$\text{Opening Ratio}=(\text{Contact area of a processing solution with air } (cm^2))\div(\text{Volume of the processing solution } (cm^3))$$

The above opening ratio is preferably 0.1 or less and more preferably in the range of from 0,001 to 0.05. As a method for reducing the opening ratio, placing a cover such as a floating lid or the like on the surface of a photographic processing solution in a processing tank, using a movable lid as disclosed in JP-A-1-82033, or a slit development processing method as disclosed in JP-A-63-216050 can be exemplified. It is preferred that reducing the opening ratio be applied to not only a color development step and a black-and-white development step but also to other various subsequent steps, such as bleaching, bleach-fixing, fixing, washing, and stabilizing. Also, an amount of the replenisher to be used can be reduced using a means for restraining the accumulation of the bromine ion in a developing solution.

A photographic emulsion layer is generally bleaching processed after being color development processed. A bleaching process and a fixing process may be carried out at the same time (bleach-fixing process) or may be conducted separately. A processing method comprising carrying out a bleach-fixing processing after a bleaching processing may be adopted for a further rapid processing. Also, processing in two successive bleach-fixing baths, fixing processing before bleach-fixing processing, or bleaching processing after bleach-fixing processing may be optionally selected according to purposes. Compounds of polyvalent metals such as ferric(III), peracids, quinones, nitro compounds and so on are used as a bleaching agent. Representative examples of bleaching agents which are preferably used in the present invention include a bleaching agent such as organic ferric(III) complex salts, e.g., ethylenediaminetetraacetic acid, diethylenetriaminepentaacetic acid, cyclohexanediaminetetraacetic acid, methyliminodiacetic acid, glycol ether diaminetetraacetic acid, and bleaching agents disclosed in JP-A-4-121739, page 4, light lower column to page 5, left upper column, for example, 1,3-propylenediaminetetraacetic acid iron complex salt, a carbamoyl based bleaching agent disclosed in JP-A-4-73647, a bleaching agent having a heterocyclic ring disclosed in JP-A-4-174432, bleaching agents disclosed in European Patent Publication No. 520457, for example, N-(2-carboxyphenyl)iminodiacetic acid ferric(III) complex salt, bleaching agents disclosed in JP-A-5-66527, for example, ethylenediamine-N-2-carboxyphenyl-N,N',N'-triacetic acid ferric(III) complex salt, bleaching agents disclosed in European Patent Publication No. 501479, bleaching agents disclosed in JP-A-4-127145, and aminopolycarboxylic acid ferric(III) salts, or salts thereof disclosed in JP-A-3-144446, page 11.

Organic aminocarboxylic acid ferric(III) complex salts are particularly useful in both a bleaching solution and a bleach-fixing solution. The pH of a bleaching solution or a bleach-fixing solution containing these organic aminocarboxylic acid ferric(III) complex salts is generally from 4.0 to 8, however, processing can be carried out with the lower pH for accelerating the processing speed.

A bleaching processing is preferably carried out immediately after color development, but in the case of a reversal processing, a bleaching processing is in general carried out via a adjustment bath (it may be a bleaching accelerating bath). These adjustment baths may contain an image stabilizing agent described later.

A bleaching processing bath which is used in the present invention can contain, in addition to a bleaching agent, a rehalogenating agent disclosed in JP-A-3-144446 page 12, a pH buffering agent, and known additives, aminopolycarboxylic acids, organic phosphonic acids, etc.

Further, a bleaching solution or a prebath thereof for use in the present invention can include various kinds of bleaching accelerators. Specific examples of such bleaching accelerators which can be used in the present invention include compounds having a mercapto group or a disulfide group disclosed in the specification of U.S. Pat. No. 3,893,858, German Patent 1,290,821, British Patent 1,138,842, JP-A-53-95630, *Research Disclosure*, No. 17129 (July, 1978), thiazolidine derivatives disclosed in JP-A-50-140129, thiourea derivatives disclosed in U.S. Pat. No. 3,706,561, iodides disclosed in JP-A-58-16235, polyethylene oxides disclosed in German Patent 2,748,430, and polyamine compounds disclosed in JP-B-45-8836 (the term "JP-B" as used herein refers to an "examined Japanese patent publication"). In addition, compounds disclosed in U.S. Pat. No. 4,552,834 are preferably used. These bleaching accelerators may be added in photographic materials. These bleaching accelerators are in particularly effective when bleach-fixing photographic materials containing a silver iodide as a silver halide. Especially preferred are mercapto compounds disclosed in British Patent 1,138,842 and JP-A-2-190856.

It is preferred to include organic acids in a bleaching solution and a bleach-fixing solution, in addition to the above compounds, for inhibiting bleaching stain. Particularly preferred are organic acids compounds having an acid dissociation constant (pKa) of from 2 to 5.5, and especially preferred are dibasic acids. Specifically, preferred monobasic acids include acetic acid, propionic acid, and hydroxyacetic acid, more preferred dibasic acids include succinic acid, glutaric acid, maleic acid, fumaric acid, malonic acid, and adipic acid, and most preferred dibasic acid are succinic acid, glutaric acid and maleic acid.

A total processing time for the desilvering processing is preferably shorter in the range without causing a desilvering failure. The desilvering processing time is preferably from 1 minute to 3 minutes and more preferably from 1 minute to 2 minutes. Further, a processing temperature is generally from 25° C., to 50° C. and preferably from 35° C. to 45° C. In the preferred range, the desilvering rate is improved and a occurrence of staining after processing is effectively prevented.

In carrying out the processing, it is particularly preferred to subject an aeration by the processing solution having a bleaching ability of the present invention to maintain the photographic performances in extremely stabilized levels. Various known aeration methods can be used including blowing air into the processing solution having a bleaching ability, or absorbing air using an ejector.

In carrying out the air blowing, it is preferred to introduce air into the solution through a diffuser having fine pores. Such a diffuser is widely used in an aeration tank in the activated sludge process. With regard to the aeration, an item described in Z-121, *Using Process C*-41, 3rd Edition, pages BL-1 to BL-2, published by Eastman Kodak (1982) can be utilized. In the processing using the processing solution having a bleaching ability of the present invention, vigorous stirring is preferred and in a practical operation, a content disclosed in JP-A-3-33847, page 8, right upper column, line 6 to left lower column, line 2 can be utilized as it is.

Stirring as vigorous as possible in the desilvering processing is preferred. Specific examples of the forced stirring include the method wherein a jet stream of the processing solution is collided on an emulsion surface of the photographic material as disclosed in JP-A-62-183460, the method wherein the stirring effect is enhanced using a rotating means as disclosed in JP-A-62-183461, the method wherein the photographic material is moved in contact with a wiper blade, which is installed in the solution, to generate turbulent flow at the surface of the emulsion so that the stirring effect may be enhanced, and the method wherein an amount of the circulating flow of the entire processing solution is increased. These means for improving the stirring level are effective for the bleaching solution, the bleach-fixing solution and the fixing solution. It is supposed that the improved stirring level increases a rate of the bleaching agent and the fixing agent supplied to the emulsion film and, thereby enhancing the desilvering rate. Further, the above means for improving stirring are more effective when a bleaching accelerator is used, and it is possible to extremely improve the bleaching accelerating effect and to eliminate a fixing hindrance due to the bleaching accelerator.

The automatic processors which are used in the present invention preferably have the means for transporting photographic materials as disclosed in JP-A-60-191257, JP-A-60-191258, and JP-A-60-191259. As described in the above JP-A-60-191257, such a transporting means can greatly reduce a carryover of the processing solution from a previous bath to a subsequent bath and is effective for preventing the deterioration of the performances of the processing solution. These effects are especially effective in shortening the processing time of each processing step and reducing the replenishment rate of each processing solution.

The processing solution having bleachable properties of the present invention can be reused by recovering the over-flow liquid and adjusting the composition by the addition of components. Such a method is generally called a regeneration and is preferably applied to the present invention. With regard to the details of the regeneration, the items disclosed in *Fuji Film Processing Manual., Fuji Color Negative Film, CN*-16 *Process*, (revised in August, 1990), pages 39–40 can be applied to.

A kit for adjusting the processing solution having a bleaching ability may be either in a liquid or a powder form. In a case where an ammonium salt is excluded, since almost all of raw materials are in a powder state, are low in hygroscopicity, the kit may be easily made in a power form.

From a viewpoint of reduction of a waste solution, the kit for the above regenerated solution is preferably in a powder form thereby not requiring excessive water and being added directly.

With regard to the regeneration of the processing solution having a bleaching ability, in addition to the above described aeration methods, the methods disclosed in *Shashin Kogaku no Kiso—Gin-en Shashin Hen* (*The Basis of Photographic Technology—Silver Salt Photography*) (edited by Nippon Shashin Gakkai, published by Corona, Co., 1979), etc., can be utilized. Specific examples of the regeneration methods of a bleaching solution include a regeneration method by electrolysis and a regeneration method by a hydrogen peroxide, a bromous acid, ozone, etc., making use of a bromic acid and a chlorous acid, a bromine, a bromine precursor, a persulfate, a hydrogen peroxide, and a catalyst.

In the regeneration method by electrolysis, a regeneration processing for bleaching solution is carried out by providing an anode and a cathode in the same bleaching bath, or separating an anode bath from a cathode bath by a diaphragm, or a bleaching solution and a developing solution and/or a fixing solution are regenerated at the same time using a diaphragm.

Regeneration of a fixing solution and a bleach-fixing solution are carried out by an electrolytic reduction of the accumulated silver ion. In addition, a removal of the accumulated halogen ion by means of an anion exchange resin is also preferred for maintaining the fixing ability.

To save an amount of washing water, an ion exchange or an ultrafiltration is utilized, and an ultrafiltration is particularly preferred.

The photographic material of the present invention is generally subjected to a washing step and/or a stabilizing step after being processed with the processing solution having a fixing ability. An amount of washing water in a washing step can be designed from a wide range of processing conditions depending on characteristics and processing method of the photographic materials (for example, used couplers, etc., used), which include a temperature of a washing water, a number of washing tanks (a number of washing stages), the replenishing system, that is, whether a countercurrent or concurrent system, and other various factors. Of the foregoing factors, the relationship between the number of washing tanks and the amount of water in a multistage countercurrent system can be obtained by the method described in *Journal of the Society of Motion Picture and Television Engineers*, Vol. 64, pages 248 to 253 (May, 1955). According to the multistage countercurrent system of the above literature, the amount of a washing water can be greatly reduced, however, problems arise such that bacteria proliferate due to the increased residence time of the water in the tanks, and suspended matters produced adhere to the photographic material. In processing color photographic materials of the present invention, the method of reducing the calcium ion and magnesium ion concentrations as disclosed in JP-A-62-288838 can be used as a sufficient effective means for overcoming these problems. Also, isothiazolone compounds and thiabendazoles as disclosed in JP-A-57-8542, chlorine based antibacterial agents such as chlorinated sodium isocyanurate, benzotriazole, and antibacterial agents disclosed in Hiroshi Horiguchi, *Bohkin Bohbai no Kagaku* (*Antibacterial and Antifungal Chemistry*), published by Sankyo Shuppan K.K. (1986), *Biseibutsu no Mekkin, Sakkin, Bohbai Gijutsu* (*Germicidal and Antifungal Techniques of Microorganisms*), edited by Eisei Gijutsukai, published by Kogyo Gijutsukai (1982), and *Bohkin Bohbai Zai Jiten* (*Antibacterial and Antifungal Agents Thesaurus*), edited by Nippon Bohkin Bohbai Gakkai (1986), can be used.

A pH of the washing water in the processing of the photographic material according to the present invention is generally from 4 to 9, preferably from 5 to 8. A temperature and a time of a washing step can be selected variously according to the characteristics and the end use purpose of the photographic material to be processed, but is generally from 15° C. to 45° C. for 20 seconds to 10 minutes, and preferably from 25° C. to 40° C. for 30 seconds to 5 minutes.

Further, the photographic material of the present invention after being processed with the processing solution having a fixing ability is preferably processed directly with a stabilizing solution without employing a washing step. Known methods as disclosed in JP-A-57-8543, JP-A-58-14834 and JP-A-60-220345 can all be used in such a stabilization processing.

A stabilizing solution contains dye image stabilizing compounds, for example, formaldehyde, benzaldehydes such as m-hydroxybenzaldehyde, bisulfite addition products of formaldehyde, hexamethylenetetramine and derivatives thereof, hexahydrotriazine and derivatives thereof, dimethylolurea, N-methylol compounds such as N-methylolpyrazole, organic acids and pH buffers. The preferred amount of these compounds is from 0.001 to 0.02 mol per liter of the stabilizing solution. It is preferred that the lower the concentration of the free formaldehyde in the stabilizing solution, the less the formaldehyde gas is scattered. From these points, m-hydroxybenzaldehyde, hexamethylenetetramine, N-methylolazoles such as N-methylolpyrazole disclosed in JP-A-4-270344, and azolylmethylamine such as N,N'-bis(1,2,4-triazol-1-ylmethyl)piperazine, etc., disclosed in JP-A-4-313753 are preferred as dye image stabilizers. Particularly, a combined use of azoles such as 1,2,4-triazole disclosed in JP-A-4-359249 (corresponding to European Patent Publication No. 519190A2) with azolylmethylamine such as 1,4-bis(1,2,4-triazol-1-ylmethyl)piperazine, and derivatives thereof is preferred because high image stability can be obtained and low vapor pressure of the formaldehyde is observed. Further, it is preferred to include various compounds in the stabilizing solution, if necessary, for example, ammonium compounds such as ammonium chloride and ammonium sulfite, metal compounds such as Bi and Al a brightening agent, a hardening agent, an alkanolamine disclosed in U.S. Pat. No. 4,786,583, and preservatives which can be included in the aforementioned fixing solution and bleach-fixing solution, e.g., sulfinic acid compounds as disclosed in JP-A-1-231051.

A washing water and/or a stabilizing solution can contain various surfactants to prevent the generation of water marks during drying of the processed photographic materials. Nonionic surfactants are preferably used above all, and alkylphenol ethylene oxide addition product is particularly preferred. Octyl-, nonyl-, dodecyl-, and dinonylphenol are preferred as the alkylphenol and an addition mol number of the ethylene oxide is preferably from 8 to 14. Further, it is preferred to use silicone based surfactants which have the high defoaming advantage.

A washing water and/or a stabilizing solution are/is preferred to contain various kinds of chelating agents. Preferred chelating agents include aminopolycarboxylic acid, e.g., ethylenediaminetetraacetic acid and diethylenetriaminepentaacetic acid, organic phosphonic acid, e.g., 1-hydroxyethylidene-1,1 -diphosphonic acid, N,N,N'-trimethylenephosphonic acid, diethylenetriamine-N,N,N',N'-tetramethylenephosphonic acid, and a hydrolysis product of a maleic anhydride polymer disclosed in EP 345,172A1, and the like.

The over-flow caused by a replenishment of the above described washing water and/or stabilizing solution can be reused in other steps such as a desilvering step, etc.

When the above each processing solution is concentrated due to evaporation in processing using an automatic processor, etc., it is preferred to replenish an appropriate amount of water, compensating solution, or replenisher of each processing solution to compensate the concentration by evaporation. There is no particular limitation on the method of supplying the water, but the following methods are preferred of all, e.g., a method wherein a separate monitoring water tank is established with the bleaching tank, and the amount of water evaporated from the bleaching tank is calculated from the amount of water evaporated from the monitoring water tank, and water is replenished to the bleaching tank in proportion to this amount of evaporation, which is disclosed in JP-A-1-254959 and JP-A-1-254960, and a method wherein a liquid level sensor or an overflow sensor is used to compensate the evaporated amount of water, disclosed in JP-A-3-248155, JP-A-3-249644, JP-A-3-249645 and JP-A-3-249646. The water to be added to the processing solution for compensating the evaporated portion of each processing solution may be city water, but the deionized water or sterilized water which is preferably used in the above washing step is preferred.

Various processing solutions of the present invention are used at a temperature of from 10° C. to 50° C. A range from 33° C. to 38° C. is a standard, however, it is possible to raise the temperature to accelerate the processing rate to shorten the processing time, on the contrary, to lower the temperature to improve the image quality or to stabilize the processing solution.

Each processing solution of the present invention can be used in two or more processing for the photographic materials in common. For example, the cost of the processor can be reduced and the processing can be simplified by processing color negative films and color papers with the same processing solution.

The photographic material is described in detail below.

The photographic material of the present invention has at least one hydrophilic colloidal layer containing a solid fine grain dispersion of a dye. Any known dye may be as such a dye which demonstrates the effect of the present invention, however, a dye in particular as a solid fine grain dispersion is preferably represented by the above formula (I).

In formula (I) a compound having a chromophore represented by D can be selected from various known dye compounds including an oxonol dye, a merocyanine dye, a cyanine dye, an allylidene dye, an azomethine dye, a triphenylmethane dye, an azo dye, an anthraquinone dye, and an indoaniline dye.

A group of dissociative proton or a group having a dissociative proton represented by X is non-dissociative when the compound represented by formula (I) is used in the silver halide color photographic material of the present invention and which has a property to make the compound represented by formula (I) substantially water-insoluble. In particular, said group is dissociated during a developing process for the photographic material (especially under the high alkaline condition, specifically, under the condition of pH 9 to 12) to make the compound of formula (I) substantially water-soluble. Examples of such a group include a carboxylic acid group, a sulfonamide group, an arylsulfamoyl group, a sulfonylcarbamoyl group, a carbonylsulfamoyl group, an enol group of an oxonol dye, and a phenolic hydroxyl group.

Of the compounds represented by formula (I), more preferred are represented by the following formulae (II), (III), (IV) and (V).

$$A_1{=}L_1{-}(L_2{=}L_3)_m Q \quad \text{(II)}$$

$$A_1{=}L_1{-}(L_2{=}L_3)_n A_2 \quad \text{(III)}$$

$$A_1{\equiv}L_1{-}L_2)_p B_1 \quad \text{(IV)}$$

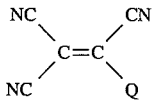
(V)

wherein $A_1$ and $A_2$ each represents an acid nucleus, $B_1$ represents a basic nucleus, Q represents an aryl group or a heterocyclic group, $L_1$, $L_2$ and $L_3$ each represents a methine group, m represents 0, 1, or 2, n and p each represents 0, 1, 2 or 3, provided that the compounds represented by formulae (II) to (V) have at least one group selected from the group consisting of a carboxylic acid group, a sulfonamide group, an arylsulfamoyl group, a sulfonylcarbamoyl group, a carbonylsulfamoyl group, an enol group of an oxonol dye, and a phenolic hydroxyl group in one molecule, and do not have other water-soluble group (e.g., a sulfonic acid group, a phosphoric acid group).

The acid nucleus represented $A_1$ or $A_2$ is preferably a cyclic ketomethylene compound or a compound having a methylene group interposed between electron attractive groups. Examples of cyclic ketomethylene groups include 2-pyrazolin-5-on, rhodanine, hydantoin, thiohydantoin, 2,4-oxazolidinedione, isooxazolone, barbituric acid, thiobarbituric acid, indanedione, dioxopyrazolopyridine, hydroxypyridone, pyrazolidinedione, and 2,5-dihydrofuran, and each of which may be substituted.

The compound having a methylene group interposed between electron attractive groups is represented by $Z_{CH2}Z_2$, wherein $Z_1$ and $Z_2$ each represents CN, $SO_2R_1$, $COR_1$, $COOR_2$, $CONHR_2$, $SO_2NHR_2$, $C(=C(CN)_2)R_1$, and $C(=C(CN)_2)NHR_1$, wherein $R_1$ represents an alkyl group, an aryl group, or a heterocyclic group, $R_2$ represents a hydrogen atom and a group represented by $R_1$, and each of which may be substituted.

Examples of the basic nucleus represented by $B_1$ include pyridine, quinoline, indolenine, oxazole, imidazole, thiazole, benzoxazole, benzimidazole, benzothiazole, oxazoline, naphthoxazole, and pyrrole, and each of which may be substituted.

Examples of the aryl group represented by Q include a phenyl group and a naphthyl group, and each of which may be substituted. Examples of the heterocyclic groups represented by Q include pyrrole, indole, furan, thiophene, imidazole, pyrazole, indolizine, quinoline, carbazole, phenothiazine, phenoxazine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, coumarin, and coumarone, each of which may be substituted.

The methine group represented by $L_1$, $L_2$ and $L_3$ may be substituted, and the substituents may be bonded each other to form a 5- or 6-membered ring (e.g., cyclopentene, cyclohexene).

There is no particular limitation on the substituents of the above described groups, provided that they do not substantially dissolve the compounds represented by formulae (I) to (V) in water having pH 5 to 7. Examples of such a substituent include a carboxylic acid group, a sulfonamide group having from 1 to 10 carbon atoms (e.g., methanesulfonamide, benzenesulfonamide, butanesulfonamide, n-octanesulfonamide), a sulfamoyl group having from 0 to 10 carbon atoms (e.g., unsubstituted sulfamoyl, methylsulfamoyl, phenylsulfamoyl, butylsulfamoyl), a sulfonylcarbamoyl group having from 2 to 10 carbon atoms (e.g., methanesulfonylcarbamoyl, propanesulfonylcarbamoyl, benzenesulfonylcarbamoyl), an acylsulfamoyl group having from 1 to 10 carbon atoms (e.g., acetylsulfamoyl, propionylsulfamoyl, pivaloylsulfamoyl, benzoylsulfamoyl), a chain or cyclic alkyl group having from 1 to 8 carbon atoms (e.g., methyl, ethyl, isopropyl, butyl, hexyl, cyclopropyl, cyclopentyl, cyclohexyl, 2-hydroxyethyl, 4-carboxybutyl, 2-methoxyethyl, benzyl, phenethyl, 4-carboxybenzyl, 2-diethylaminoethyl), an alkenyl group having from 2 to 8 carbon atoms (e.g., vinyl, allyl), an alkoxy group having from 1 to 8 carbon atoms (e.g., methoxy, ethoxy, butoxy), a halogen atom (e.g., F, Cl, Br), an amino group having from 0 to 10 carbon atoms (e.g., unsubstituted amino, dimethylamino, diethylamino, carboxyethylamino ), alkoxycarbonyl group having from 2 to 10 carbon atoms (e.g., methoxycarbonyl), an amide group having from 1 to 10 carbon atoms (e.g., acetylamino, benzamide), a carbamoyl group having from 1 to 10 carbon atoms (e.g., unsubstituted carbamoyl, methylcarbamoyl, ethylcarbamoyl), an aryl group having from 6 to 10 carbon atoms (e.g., phenyl, naphthyl, 4-carboxyphenyl, 3-carboxyphenyl, 3,5-dicarboxyphenyl, 4-methanesulfonamidophenyl, 4-butanesulfonamidophenyl), an aryloxy group having from 6 to 10 carbon atoms (e.g., phenoxy, 4-carboxyphenoxy, 3-methylphenoxy, naphthoxy), an alkylthio group having from 1 to 8 carbon atoms (e.g., methylthio, ethylthio, octylthio), an arylthio group having from 6 to 10 carbon atoms (e.g., phenylthio, naphthylthio), an acyl group having from 1 to 10 carbon atoms (e.g., acetyl, benzoyl, propanoyl), a sulfonyl group having from 1 to 10 carbon atoms (e.g., methanesulfonyl, benzenesulfonyl), a ureido group having from 1 to 10 carbon atoms (e.g., ureido, methylureido), a urethane group having from 2 to 10 carbon atoms (e.g., methoxycarbonylamino, ethoxycarbonylamino), a cyano group, a hydroxyl group, a nitro group, a heterocyclic group (e.g., a 5-carboxybenzoxazole ring, a pyridine ring, a furan ring, a pyrrole ring, a pyrrolidine ring, morpholine ring, a piperazine ring, a pyrimidine ring), etc.

Specific examples of the compounds represented by formula (I) which are used in the present invention are shown below, but the present invention is not limited thereto.

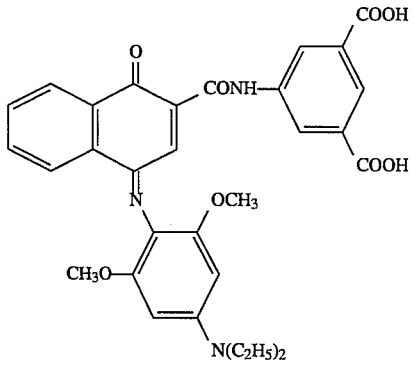

(I-1)

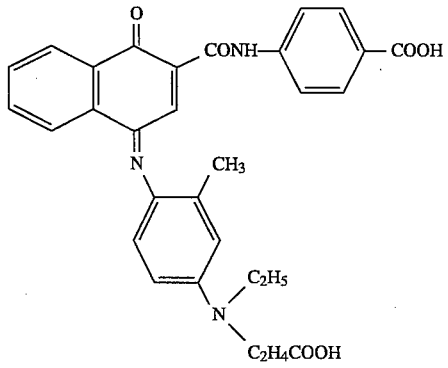

(I-2)

-continued
(I-3)
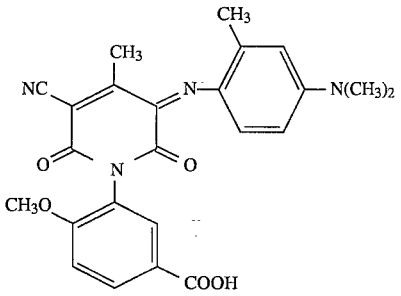
(I-4)
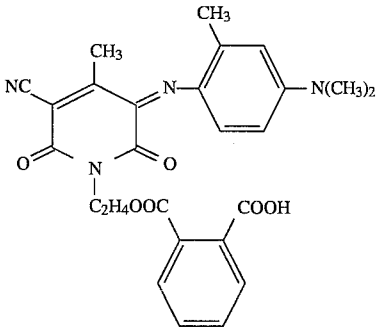
(II-1)
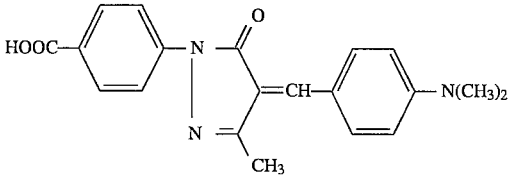
(II-2)
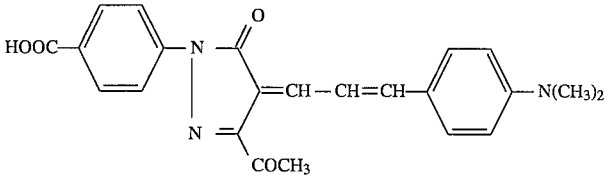
(II-3)
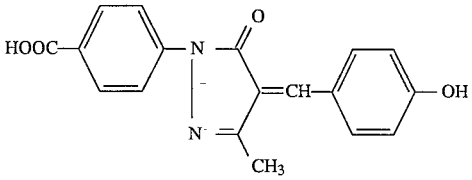
(II-4)
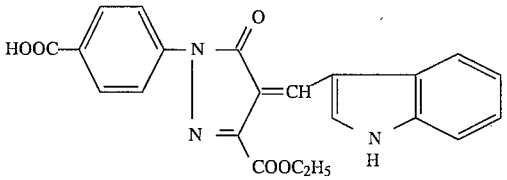

-continued
(II-5)
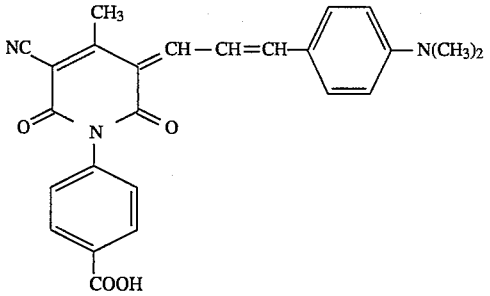
(II-6)
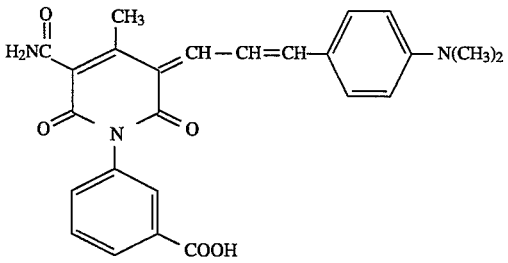
(II-7)
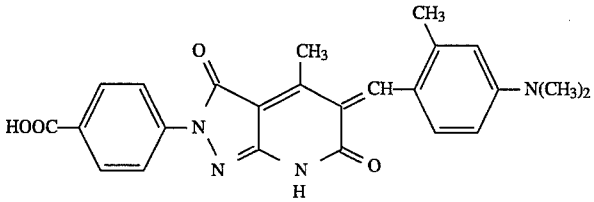
(II-8)
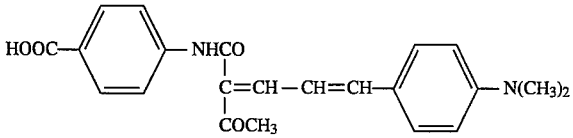
(II-9)
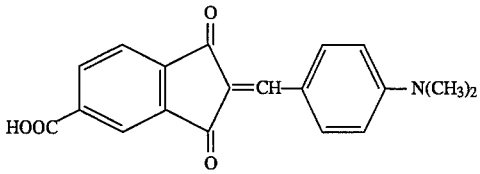
(II-10)
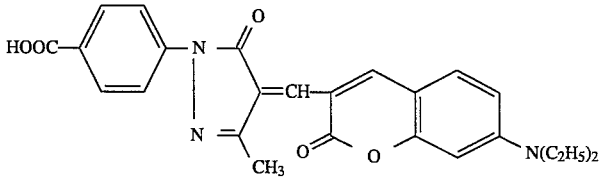
(II-11)
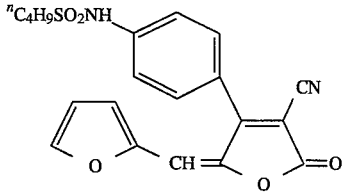

-continued
(II-12)
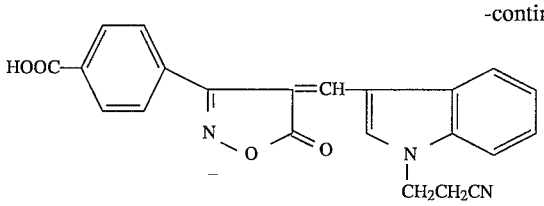
(II-13)
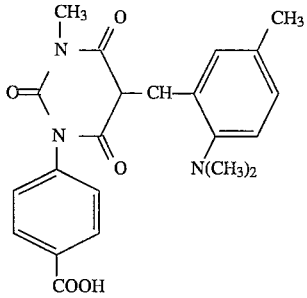
(II-14)
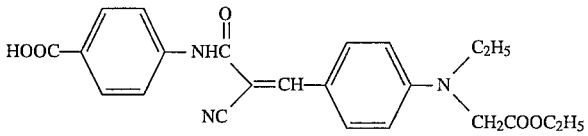
(II-15)
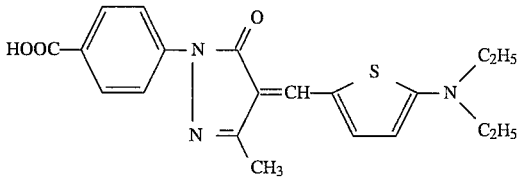
(II-16)
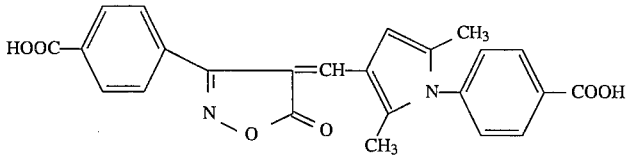
(II-17)
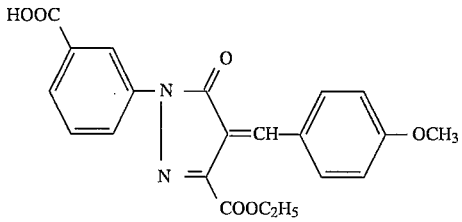
(II-18)
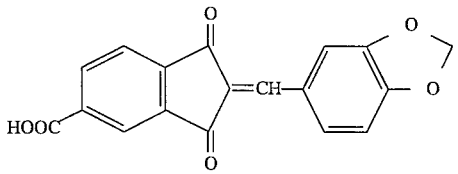
(II-19)
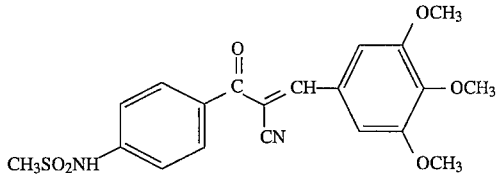

-continued
(II-20)
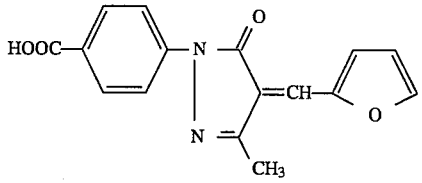
(II-21)
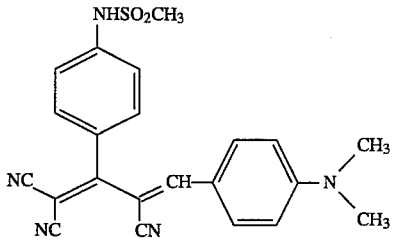
(II-22)
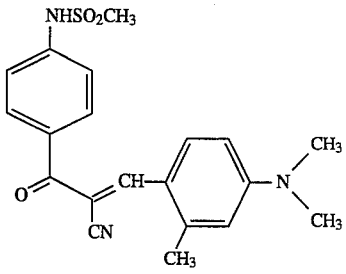
(II-23)
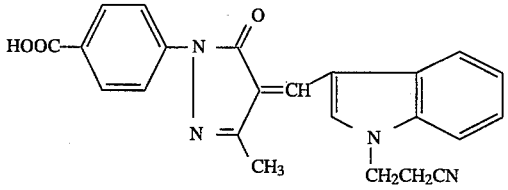
(II-24)
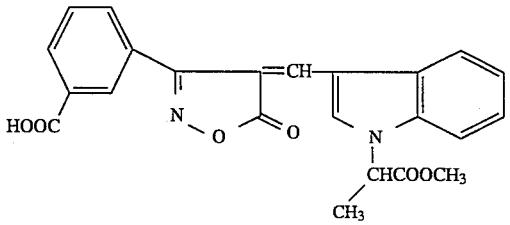
(II-25)
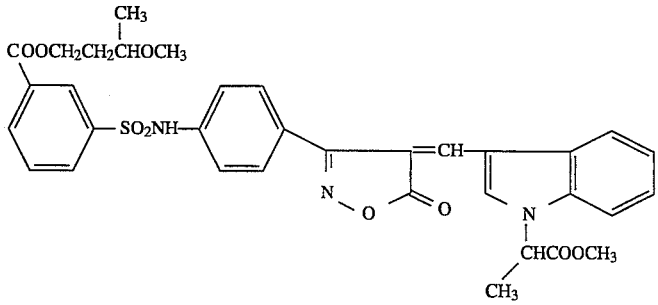
(III-1)
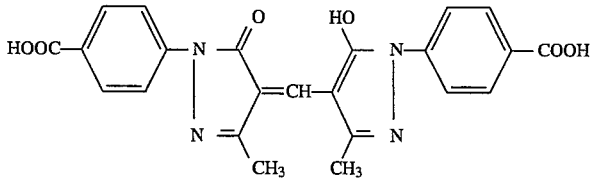

-continued
(III-2)
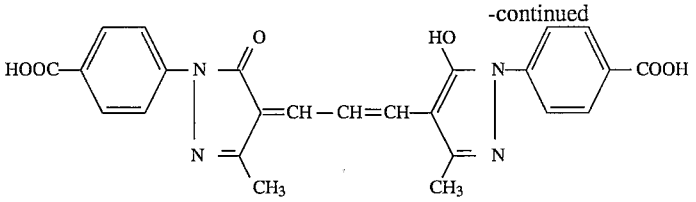
(III-3)
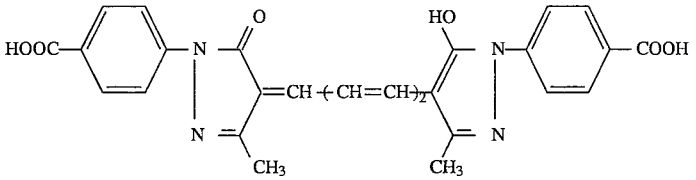
(III-4)
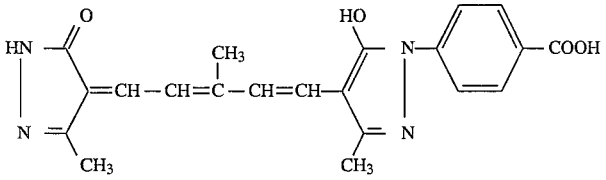
(III-5)
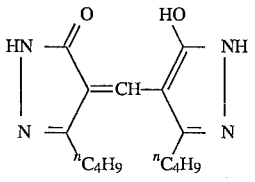
(III-6)
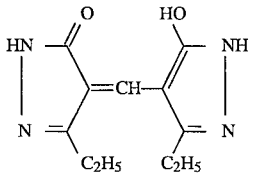
(III-7)
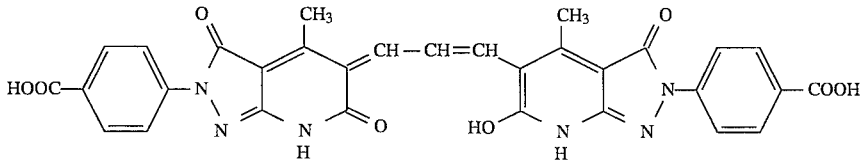
(III-8)
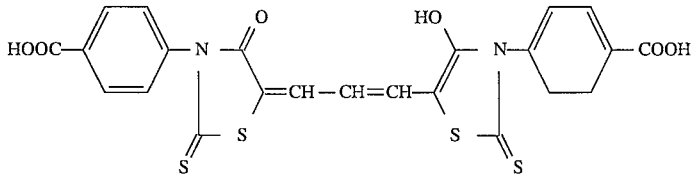
(III-9)
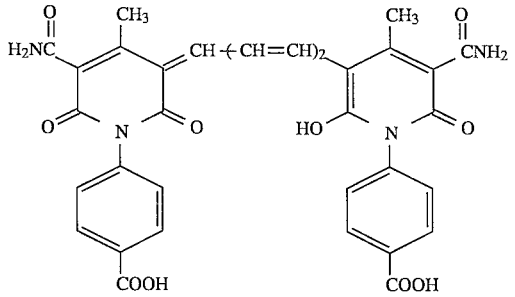

-continued
(III-10)
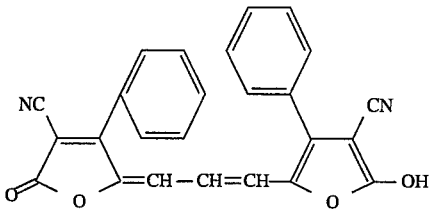
(III-11)
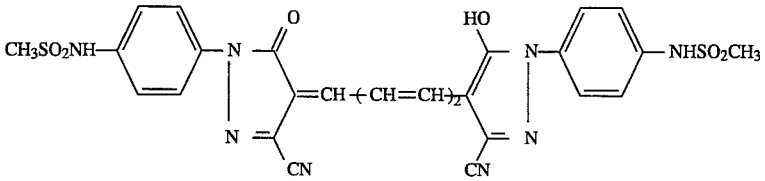
(III-12)
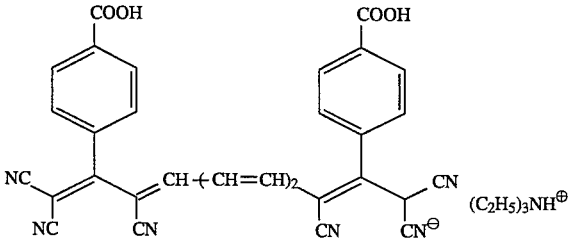
(III-13)
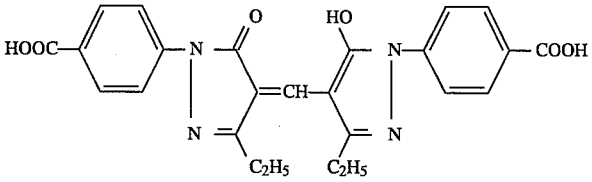
(III-14)
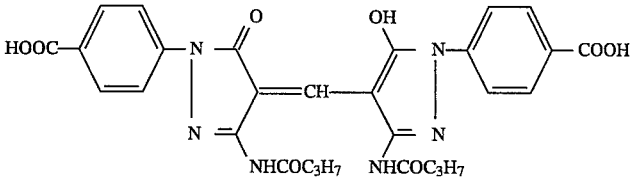
(IV-1)
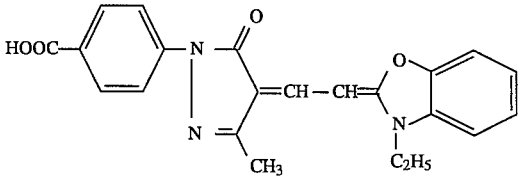
(IV-2)
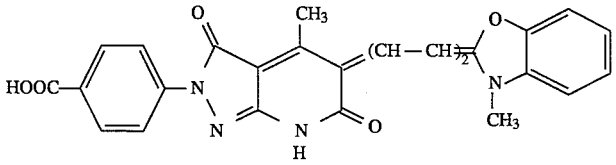
(IV-3)
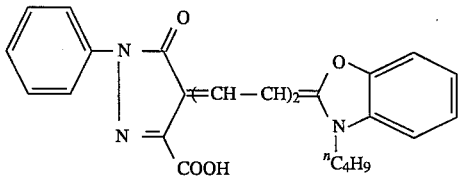

-continued (IV-4)

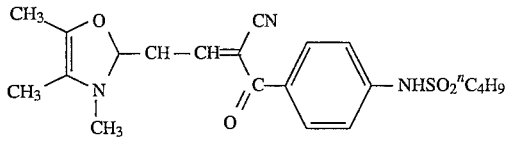

(IV-5)

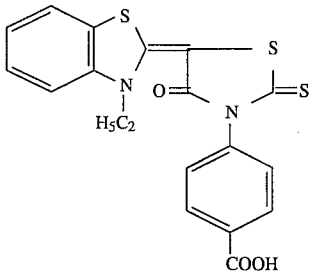

(IV-6)

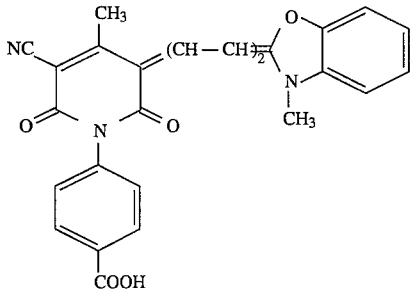

(IV-7)

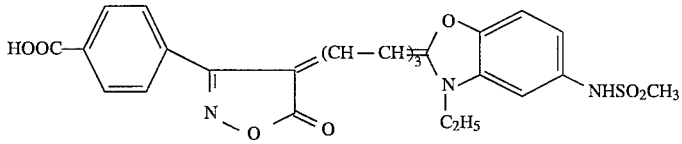

(V-1)

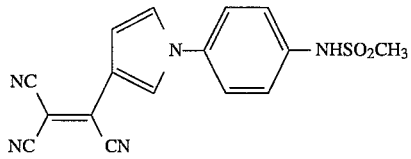

(V-2)

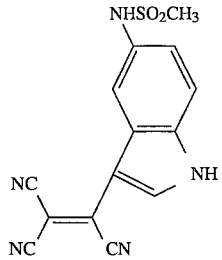

(V-3)

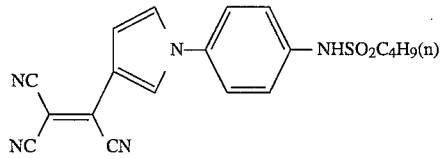

The dyes which are used in the present invention can be synthesized according to the methods, or the methods corresponding thereto, disclosed in WO 88/04794, EP 0274723A1, EP 276566, EP 299435, JP-A-52-92716, JP-A-55-155350, JP-A-55-155351, JP-A-61-205934, JP-A-48-68623, U.S. Pat. Nos. 2,527,583, 3,486,897, 3,746,539, 3,933,798, 4,130,429, 4,040,841, JP-A-3-282244, JP-A-3-7931, and JP-A-3-167546.

The dye dispersion of the present invention can be included in any arbitrary hydrophilic colloid layers such as an emulsion layer, an interlayer, etc., and may be used in a single layer or in a plurality of layers.

Particularly, it is preferred to use the dye dispersion by substituting partially or entirely the colloid silver conventionally used in a yellow filter layer or an antihalation layer.

In particular, the effects of the present invention are conspicuously demonstrated when the colloid silver in a yellow filter layer is entirely substituted with the dye dispersion of the present invention.

The amount added of the solid fine grain dispersion of the dye represented by formula (I) of the present invention is preferably from $5\times10^{-2}$ mol to $5\times10^{-7}$ mol, most preferably from $1\times10^{-3}$ mol to $5\times10^{-5}$ mol, per $m^2$ of the photographic material.

The solid fine grain dispersion of the dye represented by formula (I) of the present invention can be produced by known pulverizing methods (e.g., using a ball mill, a vibrating ball mill, a planetary ball mill, a sand mill, a colloid mill, a jet mill, a roller mill) in the presence of a dispersant, and a solvent (e.g., water, alcohol) may be used together. Further, after dissolving the dye of the present invention in an appropriate solvent, a poor solvent of the present invention may be added to deposit microcrystals, and a surfactant for dispersion may be used. Moreover, it is possible that at first the dye is dissolved by controlling the pH, and then microcrystallized by varying the pH.

The microcrystal grains of the dye dispersion of the present invention have an average grain size of from 0.005 μm to 10 μm, preferably from 0.01 μm to 1 μm, more preferably from 0.01 μm to 0.5 μm, and in some case an average grain size of from 0.01 μm to 0.1 μm is preferred.

The color photographic material of the present invention is described in detail below.

The color photographic material of the present invention is not specifically limited, provided that the material has at least one blue-sensitive silver halide emulsion layer, at least one green-sensitive silver halide emulsion layer, and at least one red-sensitive silver halide emulsion layer on a support, and a number of the silver halide emulsion layers, a number of the light-insensitive layers and an order of the layers are not specifically limited. One typical example is a silver halide photographic material comprising a support having thereon at least one light-sensitive layer comprising a plurality of silver halide emulsion layers having substantially the same color sensitivity but having a different light sensitivity. The light-sensitive layer is a unit light-sensitive layer having a color sensitivity to either of blue light, green light or red light. In a multilayer silver halide color photographic material, in general, the unit light-sensitive layers are provided in the order of a red-sensitive layer, a green-sensitive layer, and a blue-sensitive layer from the support side. However, the above order may be reversed depending on the purpose, and a different light-sensitive layer may be interposed between layers having the same color sensitivity.

Various light-insensitive layers such as interlayers may be provided between the above described silver halide light-sensitive layers, on the uppermost layer and under the lowermost layer.

The interlayer may contain couplers and DIR compounds such as those described in the specifications of JP-A-61-43748, JP-A-59-113438, JP-A-59-113440, JP-A-61-20037, and JP-A-61-20038, and may also contain color mixing inhibitors which are conventionally used.

A plurality of silver halide emulsion layers constituting each unit light-sensitive layer are preferably two-layer structures comprising a high speed emulsion layer and a low speed emulsion layer as disclosed in German Patent 1,121,470 and British Patent 923,045. In general, an arrangement in which the degree of light sensitivity of the layer closer to the support is lower is preferred, and a light-insensitive layer may be provided between each silver halide emulsion layer. Further, the low speed emulsion layer may be arranged on the remote side of the support and the high speed emulsion layer may be arranged on the near side of the support as disclosed in JP-A-57-112751, JP-A-62-200350, JP-A-62-206541 and JP-A-62-206543.

Specific examples of the layer arrangement from the side farthest from the support include a low speed blue-sensitive layer (BL)/a high speed blue-sensitive layer (BH)/a high speed green-sensitive layer (GH)/a low speed green-sensitive layer (GL)/a high speed red-sensitive layer (RH)/a low speed red-sensitive layer (RL); or the arrangement of BH/BL/GL/GH/RH/RL; or the arrangement of BH/BL/GH/GL/RL/RH.

Further, layers can be arranged from the side farthest from the support in the order of a blue-sensitive layer/GH/RH/GL/RL as described in JP-B-55-34932; and can also be arranged from the side farthest from the support in the order of a blue-sensitive layer/GL/RL/GH/RH as described in JP-A-56-25738 and JP-A-62-63936.

Still further, a useful arrangement includes a three-layer structure in which three layers having different degrees of light sensitivity are arranged such that the degree of sensitivity is lowered toward the support with the silver halide emulsion layer having the highest light sensitivity as an uppermost layer, a silver halide emulsion layer having a lower light sensitivity than the uppermost layer as an intermediate layer, and a silver halide emulsion layer having lower light sensitivity than the intermediate layer as a lowermost layer, as disclosed in JP-B-49-15495. Even in the case of the structure of this type which comprises three layers having different degrees of light sensitivity, emulsion layers in a layer of the same color sensitivity may be arranged in the order of an intermediate speed emulsion layer/a high speed emulsion layer/a low speed emulsion layer, from the side remote from the support, as disclosed in JP-A-59-202464.

Besides these, the layers may be arranged in the order of a high speed emulsion layer/a low speed emulsion layer/an intermediate speed emulsion layer, or a low speed emulsion layer/an intermediate speed emulsion layer/a high speed emulsion layer. Moreover, the arrangement of the layers may be varied as described above in the case where the layer structure comprises four or more layers.

For improving color reproducibility, it is preferred to provide a donor layer (CL) having an interlayer effect and a different spectral sensitivity distribution from a main light-sensitive layer, such as BL, GL and RL, adjacent or close to the main light-sensitive layer, as disclosed in U.S. Pat. Nos. 4,663,271, 4,705,744, 4,707,436, JP-A-62-160448 and JP-A-63-9850.

As described above, various layer structures and arrangements can be selected depending on the end use purpose of the respective photographic material. The preferred silver halides which are included in the photographic emulsion layers of the photographic materials of the present invention is a silver iodobromide, a silver iodochloride or a silver iodochlorobromide containing from about 0.2 mol % to about 30 mol % of a silver iodide. The especially preferred silver halide is a silver iodobromide or a silver iodochlorobromide containing from about 2 mol % to about 10 mol % of a silver iodide.

The silver halide grains in the photographic emulsion may have a regular crystal form such as a cubic, octahedral or tetradecahedral form, an irregular crystal form such as a spherical or tabular form, a form which has crystal defects such as twin planes, or a composite of these forms.

The silver halide may have a fine grain size of about 0.2 μm or less, or a large grain size having a projected area diameter of up to about 10 μm, and the emulsion may be a polydisperse emulsion or a monodisperse emulsion.

The silver halide photographic emulsion which can be used in the present invention can be prepared using the methods disclosed, for example, in *Research Disclosure* (RD), No. 17643 (December, 1978), pages 22 and 23, "I. Emulsion Preparation and Types", ibid., No. 18716 (November, 1979), page 648, ibid., No. 307105 (November, 1989), pages 863 to 865, P. Glafkides, *Chimie et Physique Photographique*, published by Paul Montel, 1967, G. F. Duffin, *Photographic Emulsion Chemistry*, published by Focal Press, 1966, and V. L. Zelikman et al., *Making and Coating Photographic Emulsion*, published by Focal Press, 1964.

The monodisperse emulsions disclosed in U.S. Pat. Nos. 3,574,628, 3,655,394 and British Patent 1,413,748 are also preferably used.

In addition, tabular grains having an aspect ratio of about 3 or more can also be used in the present invention. Tabular grains can easily be prepared according to the methods disclosed in Gutoff, *Photographic Science and Engineering*, Vol. 14, pages 248 to 257 (1970), U.S. Pat. Nos. 4,434,226, 4,414,310, 4,433,048, 4,439,520 and British Patent 2,112,157.

The crystal structure may be uniform, or inner and outer grains may have different halogen compositions, or the grains may have a layered structure. Further, silver halides having different compositions may be joined by an epitaxial junction, or may be joined with compounds other than a silver halide such as silver thiocyanate or lead oxide. Still further, a mixture of grains which have various crystal forms may be used.

The above described emulsions may be of any types, a surface latent image type in which the latent image is mainly formed on the surface, an internal latent image type emulsion in which the latent image is formed inner grains, or a surface and inner latent type in which the latent image is formed both at the surface and inner grains, but the emulsions should be of negative type. Of the internal latent image type, the emulsion may be a core/shell type disclosed in JP-A-63-264740. A method for preparing core/shell type internal latent image type emulsion is disclosed in JP-A-59-133542. A thickness of a shell of this emulsion is preferably from 3 nm to 40 nm and especially preferably from 5 nm to 20 nm, although it varies depending on the development processing or the like.

The silver halide emulsion is generally subjected to physical ripening, chemical ripening and spectral sensitization before use. Additives which are used in these steps are disclosed in *Research Disclosure*, No. 17643, ibid., No. 18716, and ibid., No. 307105, and the relevant locations are summarized in the following table.

Two or more types of light-sensitive silver halide emulsions which are different in at least one of the characteristics of grain size, grain size distribution, halogen composition, the form of the grains, and the sensitivity, can be used in admixture in the same layer of the photographic material of the present invention.

The surface-fogged silver halide grains disclosed in U.S. Pat. No. 4,082,553, the inner-fogged silver halide grains disclosed in U.S. Pat. No. 4,626,498 and JP-A-59-214852, and a colloidal silver are preferably used in the light-sensitive silver halide emulsion layers and/or substantially light-insensitive hydrophilic colloid layers. The inner-fogged or surface-fogged silver halide grains mean silver halide grains which can be uniformly (not imagewisely) developed, irrespective of at either an unexposed part or an exposed part of of the photographic material. Preparation methods of the inner-fogged or surface-fogged silver halide grains are disclosed in U.S. Pat. No. 4,626,498 and JP-A-59-214852.

The silver halide which forms the internal nuclei of the inner-fogged core/shell type silver halide grains may have the same halogen composition as or a different halogen composition from the core portion. The silver halide of inner-fogged or surface-fogged grains may be any of a silver chloride, a silver chlorobromide, a silver iodobromide, or a silver chloroiodobromide. Although there is no particular limitation on the grain size of the fogged silver halide grains, an average grain size is preferably from 0.01 to 0.75 μm and particularly preferably from 0.05 to 0.6 μm. There is also no particular limitation on the form of the grains, and they may be regular grains and comprise a polydisperse emulsion, but a monodisperse emulsion (at least 95% in terms of the weight or the number of the silver halide grains occupies a grain size within ±40% of the average grain size) is preferred.

The use of a light-insensitive fine silver halide grain is preferred in the present invention. The light-insensitive fine silver halide grain is not light-sensitive on imagewisely exposing for obtaining a dye image and does not substantially undergo development in the development processing. Such a light-insensitive fine silver halide grain is preferably not fogged before hand.

The fine silver halide grain contains from 0 to 100% mol % of a silver bromide, and may contain a silver chloride and/or a silver iodide, if necessary. The fine silver halide grain containing a silver iodide from 0.5 to 10 mol % is preferred.

An average grain size (the average value of the diameter of the projected area corresponding to a circle) of the fine silver halide grain is preferably from 0.01 to 0.5 μm and more preferably from 0.02 to 0.2 μm.

The fine silver halide grain can be prepared in the same methods as used for the preparation of the conventional light-sensitive silver halide, and in this case, the surface of the silver halide grains are unnecessary to be chemically sensitized nor spectrally sensitized. However, it is preferred to previously add known stabilizers such as triazole based, azaindene based, benzothiazolium based or mercapto based compounds, or zinc compounds prior to the addition to the coating solution. Colloidal silver is preferably included in the layer containing the fine grain silver halide grains.

The coating amount of silver of the photographic material of the present invention is preferably from 0.5 to 10.0 g/m$^2$, more preferably from 1.8 to 6.0 g/m$^2$ or less, and most preferably from 2.0 g/m$^2$ to 2.5 g/m$^2$, for sufficiently demonstrating the effect of the present invention.

Conventionally known photographic additives which can be used in the present invention are disclosed in the above three *Research Disclosures*, and the related parts of the disclosures are also shown in the table below.

| Type of Additives | RD 17646 | RD 18716 | RD 307105 |
|---|---|---|---|
| 1. Chemical Sensitizers | page 23 | page 648, right column | page 866 |
| 2. Sensitivity Improving Agents | — | page 648, right column | — |
| 3. Spectral Sensitizers and Supersensitizers | pages 23–24 | page 648, right column to page 649, right column | pages 866–868 |
| 4. Brightening Agents | page 24 | page 647, right column | page 868 |
| 5. Antifoggants and Stabilizers | pages 24–25 | page 649, right column | pages 868–870 |
| 6. Light Absorbers, Filter Dyes, and Ultraviolet Absorbers | pages 25–26 | page 649, right column to page 650, left column | page 873 |
| 7. Antistaining Agents | page 25, right column | page 650, left to right columns | page 872 |
| 8. Dye image Stabilizers | page 25 | page 650, left column | page 872 |
| 9. Hardening Agents | page 26 | page 651, left column | pages 874–875 |
| 10. Binders | page 26 | page 651, left column | pages 873–874 |
| 11. Plasticizers and Lubricants | page 27 | page 650, right column | page 876 |
| 12. Coating Aids and Surfactants | pages 26–27 | page 650, right column | pages 875–876 |
| 13. Antistatic Agents | page 27 | page 650, right column | pages 876–877 |
| 14. Matting Agents | — | — | pages 878–879 |

Further, it is preferred to contain compounds which react with for fixing formaldehyde as disclosed in U.S. Pat. Nos. 4,411,987 and 4,435,503 in the photographic material of the present invention for preventing deterioration of the photographic characteristics due to formaldehyde gas.

It is preferred to include mercapto compounds disclosed in U.S. Pat. Nos. 4,740,454, 4,788,132, JP-A-62-18539 and JP-A-1-283551 in the photographic material of the present invention.

It is preferred to include compounds disclosed in JP-A-1-106052, which release, irrespective of the amount of the developed silver which is produced by the development processing, fogging agents, development accelerators, silver halide solvents, or precursors of them, in the photographic material of the present invention.

Various color couplers can be employed in the color photographic material which are processed by the processing method of the present invention, and specific examples are disclosed in the patents cited in the above *Research Disclosure*, No. 17643, VII-C to G, ibid., No. 307105, VII-C to G, and JP-A-62-215272, JP-A-3-33847, JP-A-2-33144, European Patent Publication Nos. 447969A and 482552A.

Preferred yellow couplers are those disclosed, for example, in U.S. Pat. Nos. 3,933,501, 4,022,620, 4,326,024, 4,401,752, 4,248,961, JP-B-58-10739, British Patents 1,425, 020, 1,476,760, U.S. Pat. Nos. 3,973,968, 4,314,023, 4,511, 649, 5,118,599, EP 249,473A, EP 0,447,969, JP-A-63-23145, JP-A-63- 123047, JP-A-1-250944, and JP-A-1-213648, and they can be used in combination as far as the combined use does not impede the effect of the present invention.

Examples of particularly preferred yellow couplers are, for example, the yellow couplers represented by formula (Y) as disclosed in JP-A-2-139544, page 18, left upper column to page 22, left lower column, the acylacetamide based yellow couplers the acyl group of which has characteristics as disclosed in JP-A-5-2248 and European Patent Publication No. 0447969, and the yellow couplers represented by formula (Cp-2) as disclosed in JP-A-5-27389 and European Patent Publication No. 0446863A2.

5-Pyrazolone based compounds and pyrazoloazole based compounds are preferred as magenta couplers, and more preferred of them are those disclosed in U.S. Pat. Nos. 4,310,619, 4,351,897, EP 73,636, U.S. Pat. Nos. 3,061,432, 3,725,067, *Research Disclosure*, No. 24220 (June, 1984), JP-A-60-33552, *Research Disclosure*, No. 24230 (June, 1984), JP-A-60-43659, JP-A-61-72238, JP-A-60-35730, JP-A-55-118034, JP-A-60-185951, U.S. Pat. Nos. 4,500, 630, 4,540,654, 4,556,630 and WO 88/04795.

Especially preferred magenta couplers are the pyrazoloazole based magenta couplers represented by formula (I) as disclosed in JP-A-2-139544, page 3, right lower column to page 10, right lower column, and the 5-pyrazolone based magenta couplers represented by formula (M-1) as disclosed in JP-A-2-135944, page 17, left lower column to page 21, left upper column. The most preferred are the foregoing pyrazoloazole based magenta couplers.

Phenol based couplers and naphthol based couplers are representative as cyan couplers, and preferred are those disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, German Patent Publication No. 3,329,729, EP 0,121,365A, EP 0,249,453A, U.S. Pat. Nos. 3,446,622, 4,333,999, 4,775,616, 4,451,559, 4,427,767, 4,690,889, 4,254,212, 4,296,199, and JP-A-61-42658. In addition to the above, the following couplers can also be used, for example, the pyrazoloazole based couplers disclosed in JP-A-64-553, JP-A-64-554, JP-A-64-555, and JP-A-64-556, the pyrrolotriazole based couplers disclosed in European Patent Publication Nos. 0,488,248, and 0,491,197, the pyrroloimidazole based couplers disclosed in European Patent Publication No. 0,456,226A, the pyrazolopyrimidine based couplers disclosed in JP-A-64-46753, the imidazole based couplers disclosed in U.S. Patent 4,818,672 and JP-A-2-33144, the pyrrolotriazine based couplers disclosed in JP-A-4-204730, the cyclic active methylene based cyan couplers disclosed in JP-A-64-32260, and the couplers disclosed in JP-A-l-183658, JP-A-2-262655, JP-A-2-85851 and JP-A-3-48243.

Typical examples of polymerized color forming couplers are disclosed in U.S. Pat. Nos. 3,451,820, 4,080,211, 4,367, 282, 4,409,320, 4,576,910, British Patent 2,102,137 and EP 341,188A, etc.

The couplers disclosed in U.S. Pat. No. 4,366,237, British Patent 2,125,570, EP 96,570 and German Patent Publication No. 3,234,533 are preferred as couplers the colored dyes of which-have an appropriate diffusibility.

The preferred colored couplers for correcting the unnecessary absorption of colored dyes are disclosed in *Research Disclosure*, No. 17643, item VII-G, ibid., No. 307105, item VII-G, U.S. Pat. No. 4,163,670, JP-B-57-39413, U.S. Pat. Nos. 4,004,929, 4,138,258, and British Patent 1,146,368. Further, it is also preferred to use the couplers which correct the unnecessary absorption of colored dyes by the fluorescent dyes released upon coupling as disclosed in U.S. Pat. No. 4,774,181, and the couplers which have, as separable groups, dye precursor groups which are able to form dyes by reacting with the developing agent as disclosed in U.S. Pat. No. 4,777,120.

Compounds which release photographically useful residual groups upon coupling can also preferably be used in the present invention. The preferred DIR couplers which release development inhibitors are disclosed, for example, in the patents cited in the foregoing *Research Disclosure*, No. 17643, item VII-F and ibid., No. 307105, item VII-F, and JP-A-57-151944, JP-A-57-154234, JP-A-60-184248, JP-A-63-37346, JP-A-63-37350, U.S. Pat. Nos. 4,248,962 and 4,782,012.

The bleaching accelerator releasing couplers disclosed in *Research Disclosure*, No. 11449, ibid., No. 24241 and JP-A-61-201247 are effective for reducing the time required in the processing step having a bleaching ability, and the effect is significant especially when they are included in photographic materials containing the above described tabular silver halide grains. The couplers disclosed in British Patents 2,097,140, 2,131,188, JP-A-59-157638, and JP-A-59-170840 are preferred as couplers which imagewise release nucleating agents or development accelerators at the time of development. The compounds which release fogging agents, development accelerators, and silver halide solvents, etc., by the oxidation reduction reaction with the oxidant of a developing agent as disclosed in JP-A-60-107029, JP-A-60-252340, JP-A-1-44940 and JP-A-1-45687 are also preferred.

Other compounds which can be used in the photographic material of the present invention include the competitive couplers disclosed in U.S. Pat. No. 4,130,427, the multi-equivalent couplers disclosed in U.S. Pat. Nos. 4,283,472, 4,338,393 and 4,310,618, the DIR redox compound releasing couplers, DIR coupler releasing couplers, DIR coupler releasing redox compounds and DIR redox releasing redox compounds disclosed in JP-A-60-185950 and JP-A-62-24252, the couplers which release dyes which restore colors after separation disclosed in EP 173,302A and EP 313,308A, the ligand releasing couplers disclosed in U.S. Pat. No. 4,555,477, the leuco dye releasing couplers disclosed in JP-A-63-75747, and the couplers which release fluorescent dyes disclosed in U.S. Pat. No. 4,774,181.

The standard addition amount of the couplers is in the range of from 0.001 to 1 mol per mol of the light-sensitive silver halide, preferably, from 0.01 to 0.5 mol of yellow couplers, from 0.003 to 0.3 mol of magenta couplers, and from 0.002 to 0.3 mol of cyan couplers.

The couplers for use in the color photographic material of the present invention can be introduced into the photographic material using various known dispersion methods.

Examples of the high boiling point solvents which are used in an oil-in-water dispersion method are disclosed in U.S. Pat. 2,322,027, etc. Specific examples of the high boiling point organic solvents having a boiling point of 175° C. or higher under atmospheric pressure which are used in the oil-in-water dispersion method include phthalic acid esters (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate, etc.), phosphoric acid or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate, etc.), benzoic acid esters (e.g., 2-ethylhexyl benzoate, dodecyl benzoate, 2-ethylhexyl-p-hydroxy benzoate, etc.), amides (e.g., N,N-diethyldodecanamide, N,N-diethyllaurylamide, N-tetradecylpyrrolidone, etc.), alcohols or phenols (e.g., isostearyl alcohol, 2,4-di-tert-amylphenol, etc.), aliphatic carboxylic acid esters (e.g., bis(2-ethylhexyl) sebacate, dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc. Further, an organic solvent having a boiling point of about 30° C. or more and preferably from 50° C. to about 160° C. can be used as an auxiliary solvent, for example, ethyl acetate, butyl acetate, ethyl propionate, methyl ethyl ketone, cyclohexanone, 2-ethoxyethyl acetate, and dimethylformamide.

The process and effects of the latex dispersion method and specific examples of latexes for impregnation are disclosed in U.S. Pat. No. 4,199,363, German Patent Application (OLS) Nos. 2,541,274 and 2,541,230.

The compounds for improving color preservability as disclosed in EP 0,277,589A2 can be used in the color photographic material of the present invention in combination with the couplers, and particularly preferably in combination with the pyrazoloazole based magenta couplers.

Various kinds of discoloration inhibitors can also be used in combination in the photographic material of the present invention. Representative examples of organic discoloration inhibitors include hindered phenols such as hydroquinones, 6-hydroxychromans, 5-hydroxycoumarans, spirochromans, p-alkoxyphenols, and bisphenols, gallic acid derivatives, methylenedioxybenzenes, aminophenols, hindered amines, and ethers and ester derivatives obtained by silylating or alkylating the phenolic hydroxyl groups contained in each of these compounds.

Hydroquinone derivatives, aminophenol derivatives, gallic acid derivatives, and ascorbic acid derivatives may be included in the photographic materials of the present invention as a color antifoggant.

Benzotriazole based ultraviolet absorbers as disclosed, for example, in U.S. Pat. No. 3,533,794 are more effectively included in the cyan coloring layer or both layers adjacent thereto for preventing degradation of cyan dye images due to heat and particularly due to light.

The addition to the photographic materials of the present invention of various anticeptics and antimolds such as phenethyl alcohol, or 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole, etc., as disclosed in JP-A-63-257747, JP-A-62-272248 and JP-A-1-80941 is preferred.

The total film thickness of all the hydrophilic colloid layers on the side where the emulsion layers are provided is preferably from 5 to 28 μm, more preferably from 10 to 23 μm, still more preferably from 12 to 18 μm or less, and particularly preferably from 12 to 16 μm or less, because the effect of the present invention is particularly conspicuously exhibited. Further, the film swollen rate T½ is preferably from 2 to 30 seconds, and more preferably from 3 to 20 seconds. The film thickness means the film thickness measured under the conditions of 25° C. 55% relative humidity (stored for 2 days), and the film swollen rate T½ can be measured by means of the well known methods in the industry. For example, T½ can be measured using a swellometer of the type disclosed in A. Green, et al., *Photogr. Sci. Eng.*, Vol. 19, No. 2, pages 124 to 129. T½ is defined as the time to reach ½ of the saturated film thickness, taking 90% of the maximum swollen film thickness reached when being processed at 30° C. for 3 min and 15 sec in a color developing solution as the saturated film thickness.

The film swollen rate T½ can be adjusted by adding a hardening agent to gelatin as a binder or varying the aging conditions after coating. Further, a swelling factor of from 150 to 400% is preferred. The swelling factor can be calculated from the maximum swollen film thickness obtained under the above described conditions by the equation: (maximum swollen film thickness—film thickness)/film thickness.

The provision of a hydrophilic colloid layer (backing layer) having a total dry film thickness of from 2 μm to 20 μm on the side of the support opposite to the emulsion layers is preferred in the photographic material of the present invention. It is preferred to include the aforesaid light absorber, a filter dye, an ultraviolet absorber, an antistatic agent, a hardening agent, a binder, a plasticizer, a lubricant, a coating aid, or a surfactant in the backing layer. The swelling factor of the backing layer is preferably from 150 to 500%.

Color developing agents may be incorporated in the silver halide color photographic materials of the present invention to simplify and speed up processings. Various color developing agent precursors are preferred for the incorporation. For example, the indoaniline based compounds disclosed in U.S. Pat. No. 3,342,597, the Schiff's base type compounds disclosed in U.S. Pat. No. 3,342,599, *Research Disclosure*, Nos. 14850 and 15159, the aldol compounds disclosed in *Research Disclosure*, No. 13924, the complexes of metal salts disclosed in U.S. Pat. No. 3,719,492, and urethane based compounds disclosed in JP-A-53-135628 can be used for the above purpose.

Various kinds of 1-phenyl-3-pyrazolidones may be incorporated in silver halide color photographic materials of the present invention, if necessary, for the purpose of accelerating color development. Representative examples of such a compound are disclosed in JP-A-56-64339, JP-A-57-144547 and JP-A-58-115438.

Suitable supports which can be used in the photographic material of the present invention are described, for example, in *RD*, No. 17643, page 28, ibid., No. 18716, page 647, right column to page 648, left column, and ibid., No. 307105, page 879.

The various kinds of plastic films as disclosed in JP-A-4-124636, page 5, right upper column, from line 1 to line 6, to page 6, right upper column, line 5, can be used as materials for the support, and preferred examples include cellulose derivatives (e.g., diacetyl-, triacetyl-, propionyl-, butanoyl-, acetylpropionyl-acetate), and polyesters disclosed in JP-B-48-40414 (e.g., polyethylene terephthalate, poly-1,4-cyclohexanedimethylene terephthalate, polyethylene naphthalate).

These supports are preferred to be subjected to heat setting treatment after being biaxially stretched before use, and they may be heat relaxed, if necessary. Further, these supports are preferred to be previously subjected to heat treatment at a temperature lower than Tg (glass transition temperature) to reduce the curling habit. For example, the Tg of polyethylene terephthalate is about 120° C., therefore, it is preferred for carrying out the heat treatment at 119° C. or less for 0.2 to 48 hours, more preferably at 115° C. for 24 hours, in the case of polyethylene terephthalate. It is effective and preferred for the shortening of the heat treatment time to raise the temperature one time higher than the Tg and is then cooled gradually near the Tg. In the case of polyethylene naphthalate, the heat treatment time can be extremely shortened by maintaining the temperature one time between 130° C. and 200° C., then cooling to 125° C., and after then further gradually cooling to 100° C. for over 40 minutes.

The preferred materials which are used in the present invention as a film support include polyethylene terephthalate, and the polyethylene naphthalate which is disclosed in *Kino Zairyo* (*Functional Materials*), CMC K. K., February, 1991, pages 20 to 28, because these materials can bring forth higher effect by the constitution of the present invention.

The thickness of the support of the photographic material of the present invention is preferably from 70 to 130 μm and particularly preferably from 80 to 120 μm.

When the photographic material of the present invention is used as a color film, a support is preferably the support having a magnetic recording layer as disclosed in WO 90/04205, FIG. 1A. Such a support having a magnetic recording layer is preferably provided, on one side thereof, with an electrically conductive layer containing zinc, titanium or tin as disclosed in JP-A-4-62543. The support which has a stripe magnetic recording layer and a transparent magnetic recording layer adjacent to the stripe magnetic recording layer, as disclosed in JP-A-4-124628, can also be used. The protective layer disclosed in JP-A-4-73737 can be provided on the magnetic recording layer.

Any known package may be used as the package (the patrone) to contain the photographic material of the present invention, however, the packages of the shapes as described in U.S. Pat. No. 4,834,306, FIG. 1 to FIG. 3, or those described in U.S. Pat. No. 4,846,418, FIG. 1 to FIG. 3 are preferably used.

Any known format can be applied as the format of the films which are used in the present invention, such as type 135 defined by JIS K-7519 (1982), as well as the format described in JP-A-4-287040.

The photographic material of the present invention is further effective when applied to the film unit equipped with a lens as disclosed in JP-B-2-32615 and Japanese Utility Model Publication 3-39784.

The automatic developing machine (processors) which can be used in the processing of the present invention are as follows.

FP560BAL, FP360BAL, FP900AL, FP550B, FP350, FP230B, FNCP900III, FNCP600II and FNCP300 which are all manufactured by Fuji Photo Film Co., Ltd.

The detailed explanations of the above automatic developing machine (processors) are disclosed in reference manuals, for example, an instruction manual (for superintendent/operator), a service manual, and a list of parts, etc.

According to the present invention, prevention of cyan stain increase and remarkable speed up of the fixing step can be attained by processing the silver halide photographic material containing the solid fine grain dispersion of a dye with the fixing solution containing a thiosulfonic acid compound.

The present invention is explained in detail below, however, the present invention is not limited thereto.

EXAMPLE 1

Sample 101 of a multilayer color photographic material was prepared by coating each layer having the following composition on an undercoated cellulose triacetate film support.

Composition of Light-Sensitive Layer

The main components for use in each layer are classified as follows:

ExC: Cyan Coupler

ExM: Magenta Coupler

ExY: Yellow Coupler

ExS: Sensitizing Dye

UV: Ultraviolet Absorber

HBS: High Boiling Point Organic Solvent

H: Hardening Agent for Gelatin

The coated amount of silver halide and colloidal silver indicates the amount of silver in unit of $g/m^2$, the coated amount of a coupler, an additive and gelatin is indicated in unit of $g/m^2$, and the coated amount of a sensitizing dye is indicated in mol per mol of silver halide in the same layer.

| First Layer: (Antihalation Layer) | |
|---|---|
| Black Colloidal Silver | as Ag 0.20 |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| HBS-1 | 0.30 |
| HBS-2 | $1.2 \times 10^{-2}$ |
| **Second Layer: (Intermediate Layer)** | |
| Fine Grain Silver Iodobromide (AgI content: 1.0 mol %, diameter corresponding to sphere: 0.07 μm) | as Ag 0.15 |
| Gelatin | 1.00 |
| ExC-4 | $6.0 \times 10^{-2}$ |
| Cpd-3 | $2.0 \times 10^{-2}$ |
| **Third Layer: (Low Sensitive Red-Sensitive Emulsion Layer)** | |
| Silver Iodobromide Emulsion A | as Ag 0.42 |
| Silver Iodobromide Emulsion B | as Ag 0.40 |
| Gelatin | 1.90 |
| ExS-1 | $6.8 \times 10^{-4}$ mol |
| ExS-2 | $2.2 \times 10^{-4}$ mol |
| ExS-3 | $6.0 \times 10^{-5}$ mol |
| ExC-1 | 0.65 |
| ExC-3 | $1.0 \times 10^{-2}$ |
| ExC-4 | $2.3 \times 10^{-2}$ |
| HBS-1 | 0.32 |
| **Fourth Layer: (Middle Sensitive Red-Sensitive Emulsion Layer)** | |
| Silver Iodobromide Emulsion C | as Ag 0.85 |
| Gelatin | 0.91 |
| ExS-1 | $4.5 \times 10^{-4}$ mol |
| ExS-2 | $1.5 \times 10^{-4}$ mol |
| ExS-3 | $4.5 \times 10^{-5}$ mol |
| ExC-1 | 0.13 |
| ExC-2 | $6.2 \times 10^{-2}$ |
| ExC-4 | $4.0 \times 10^{-2}$ |
| ExC-6 | $3.0 \times 10^{-2}$ |
| HBS-1 | 0.10 |
| **Fifth Layer: (High Sensitive Red-Sensitive Emulsion Layer)** | |
| Silver Iodobromide Emulsion D | as Ag 1.50 |
| Gelatin | 1.20 |
| ExS-1 | $3.0 \times 10^{-4}$ mol |
| ExS-2 | $9.0 \times 10^{-5}$ mol |
| ExS-3 | $3.0 \times 10^{-5}$ mol |
| ExC-2 | $8.5 \times 10^{-2}$ |
| ExC-5 | $3.6 \times 10^{-2}$ |
| ExC-6 | $1.0 \times 10^{-2}$ |
| ExC-7 | $3.7 \times 10^{-2}$ |
| HBS-1 | 0.12 |
| HBS-2 | 0.12 |

-continued

| Sixth Layer: (Intermediate Layer) | |
|---|---|
| Gelatin | 1.00 |
| Cpd-4 | $8.0 \times 10^{-2}$ |
| HBS-1 | $8.0 \times 10^{-2}$ |
| **Seventh Layer: (Low Sensitive Green-Sensitive Emulsion Layer)** | |
| Silver Iodobromide Emulsion E | as Ag 0.28 |
| Silver Iodobromide Emulsion F | as Ag 0.16 |
| Gelatin | 1.20 |
| ExS-4 | $7.5 \times 10^{-4}$ mol |
| ExS-5 | $3.0 \times 10^{-4}$ mol |
| ExS-6 | $1.5 \times 10^{-4}$ mol |
| ExM-1 | 0.50 |
| ExM-2 | 0.10 |
| ExM-5 | $3.5 \times 10^{-2}$ |
| HBS-1 | 0.20 |
| HBS-3 | $3.0 \times 10^{-2}$ |
| **Eighth Layer: (Middle Sensitive Green-Sensitive Emulsion Layer)** | |
| Silver Iodobromide Emulsion G | as Ag 0.57 |
| Gelatin | 0.45 |
| ExS-4 | $5.2 \times 10^{-4}$ mol |
| ExS-5 | $2.1 \times 10^{-4}$ mol |
| ExS-6 | $1.1 \times 10^{-4}$ mol |
| ExM-1 | 0.12 |
| ExM-2 | $7.1 \times 10^{-3}$ |
| ExM-3 | $3.5 \times 10^{-2}$ |
| HBS-1 | 0.15 |
| HBS-3 | $1.0 \times 10^{-2}$ |
| **Ninth Layer: (Intermediate Layer)** | |
| Gelatin | 0.50 |
| HBS-1 | $2.0 \times 10^{-2}$ |
| **Tenth Layer: (High Sensitive Green-Sensitive Emulsion Layer)** | |
| Silver Iodobromide Emulsion H | as Ag 1.30 |
| Gelatin | 1.20 |
| ExS-4 | $3.0 \times 10^{-4}$ mol |
| ExS-5 | $1.2 \times 10^{-4}$ mol |
| ExS-6 | $1.2 \times 10^{-4}$ mol |
| ExM-4 | $5.8 \times 10^{-2}$ |
| ExM-6 | $5.0 \times 10^{-3}$ |
| ExC-2 | $4.5 \times 10^{-3}$ |
| Cpd-5 | $1.0 \times 10^{-2}$ |
| HBS-1 | 0.25 |
| **Eleventh Layer: (Yellow Filter Layer)** | |
| Gelatin | 0.50 |
| Yellow Colloidal Silver | $5.2 \times 10^{-2}$ |
| HBS-1 | 0.12 |
| **Twelfth Layer: (Intermediate Layer)** | |
| Gelatin | 0.45 |
| Cpd-3 | 0.10 |
| **Thirteenth Layer: (Low Sensitive Blue-Sensitive Emulsion Layer)** | |
| Silver Iodobromide Emulsion I | as Ag 0.20 |
| Gelatin | 1.00 |
| ExS-7 | $3.0 \times 10^{-4}$ mol |
| ExY-1 | 0.60 |
| ExY-2 | $2.3 \times 10^{-2}$ |
| HBS-1 | 0.15 |
| **Fourteenth Layer: (Middle Sensitive Blue-Sensitive Emulsion Layer)** | |
| Silver Iodobromide Emulsion J | as Ag 0.19 |
| Gelatin | 0.35 |
| ExS-7 | $3.0 \times 10^{-4}$ mol |
| ExY-1 | 0.22 |
| HBS-1 | $7.0 \times 10^{-2}$ |
| **Fifteenth Layer: (Intermediate Layer)** | |
| Fine Grain Silver Iodobromide (AgI content: 2 mol %, uniform AgI type, diameter corresponding to sphere: | as Ag 0.20 |

-continued

| | |
|---|---|
| 0.13 μm) | |
| Gelatin | 0.36 |
| Sixteenth Layer: (High Sensitive Blue-Sensitive Emulsion Layer) | |
| Silver Iodobromide Emulsion K | as Ag 1.55 |
| Gelatin | 1.00 |
| ExS-8 | $2.2 \times 10^{-4}$ mol |
| ExY-1 | 0.21 |
| HBS-1 | $7.0 \times 10^{-2}$ |
| Seventeenth Layer: (First Protective Layer) | |
| Gelatin | 1.80 |
| UV-1 | 0.13 |
| UV-2 | 0.21 |
| HBS-1 | $1.0 \times 10^{-2}$ |
| HBS-2 | $1.0 \times 10^{-2}$ |
| Eighteenth Layer: (Second Protective Layer) | |
| Fine Silver Chloride Grain (diameter corresponding to sphere: 0.07 μm) | as Ag 0.36 |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |
| H-1 | 0.35 |
| Cpd-6 | 1.00 |

In addition to the above components, 1,2-benzisothiazolin-3-one (in an average amount of about 200 ppm based on gelatin), n-butyl-p-hydroxybenzoate (in an average amount of about 1,000 ppm based on gelatin), and 2-phenoxy ethanol (in an average amount of about 10,000 ppm based on gelatin) were included in the thus-prepared sample. Further, B-4 to B-6, W-2, W-3, F-1 to F-15, iron salts, lead salts, gold salts, platinum salts, iridium salts and rhodium salts and palladium salts were included in the sample.

TABLE 1

| Emulsion | Average AgI Content (%) | Diameter Corresponding to a Sphere (μm) | Variation Coefficient of the Grain Size (%) | Average Diameter Corresponding to a Circle (μm) | Average Thickness (μm) | Structure of the Grain | Form |
|---|---|---|---|---|---|---|---|
| A | 9 | 0.75 | 18 | 1.16 | 0.21 | Triple Structure | Tabular |
| B | 3 | 0.50 | 10 | 0.50 | 0.50 | Triple Structure | Cubic |
| C | 9 | 0.83 | 15 | 1.32 | 0.22 | Triple Structure | Tabular |
| D | 5 | 1.20 | 15 | 1.90 | 0.32 | Triple Structure | Tabular |
| E | 5 | 0.70 | 18 | 1.13 | 0.18 | Triple Structure | Tabular |
| F | 3 | 0.48 | 10 | 0.48 | 0.48 | Triple Structure | Octahedral |
| G | 7 | 0.80 | 15 | 1.25 | 0.22 | Triple Structure | Tabular |
| H | 4.5 | 1.15 | 15 | 1.97 | 0.26 | Triple Structure | Tabular |
| I | 1.5 | 0.55 | 20 | 0.90 | 0.14 | Triple Structure | Tabular |
| J | 8 | 0.80 | 16 | 1.19 | 0.24 | Triple Structure | Tabular |
| K | 7 | 1.45 | 14 | 2.31 | 0.38 | Triple Structure | Tabular |

In Table 1:

(1) Each emulsion was reduction sensitized at the preparation of the grains using thiourea dioxide and thiosulfonic acid according to the examples of JP-A-2-191938.

(2) Each -emulsion was gold, sulfur, and selenium sensitized, respectively, in the presence of the spectral sensitizing dyes which are described at each light-sensitive layer and sodium thiocyanate according to the examples of JP-A-3-237450.

(3) Low molecular weight gelatin was used in the preparation of the tabular grains according to the examples of JP-A-l-158426.

(4) There were observed, using a high voltage electron microscope, such dislocation lines as disclosed in JP-A-3-237450 in tabular grains and normal crystal grains having grain structures.

UV-1
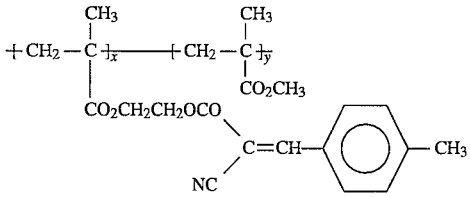
x/y = 7/3 (by weight ratio)
UV-2
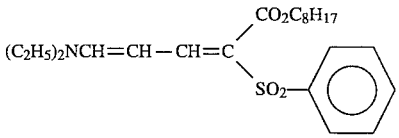
ExC-1
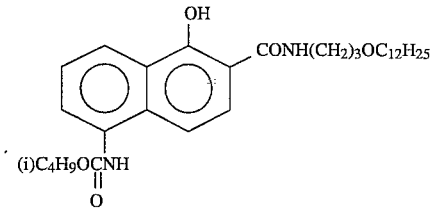
ExC-2
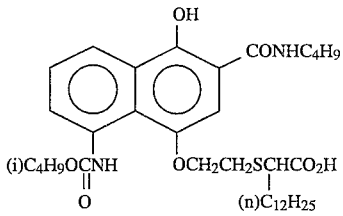
ExC-3
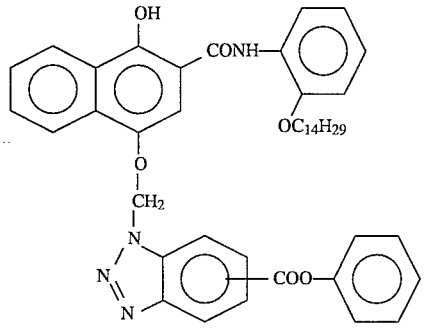
ExC-4
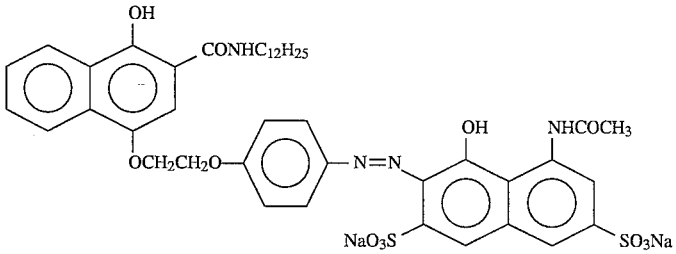
ExC-5
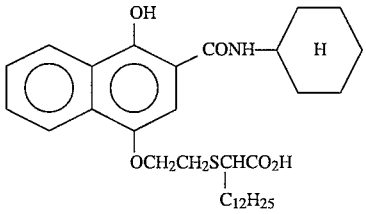
ExC-6
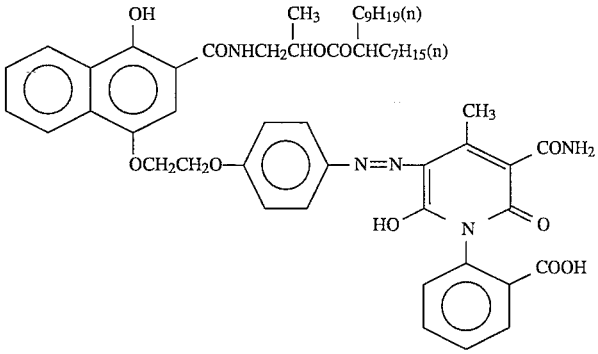

-continued
ExC-7
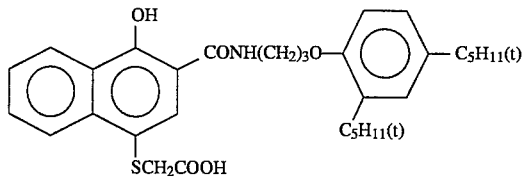
ExM-1
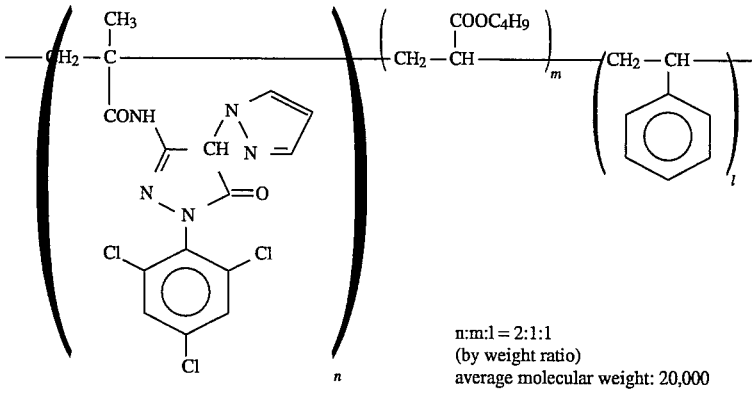
ExM-2
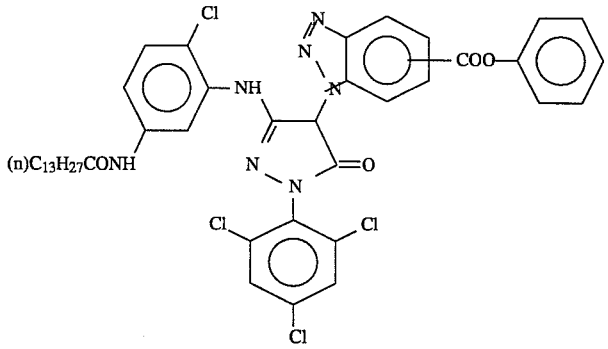
ExM-3
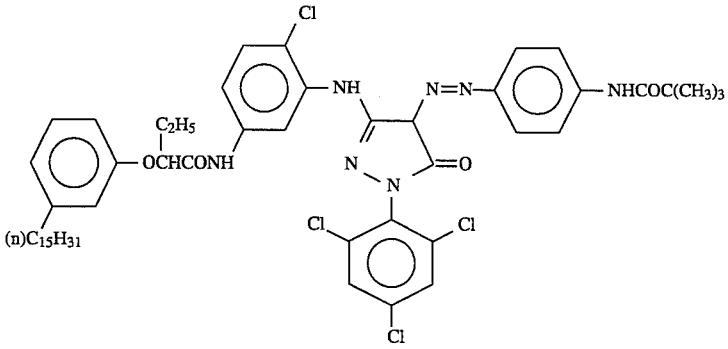

-continued
ExM-4
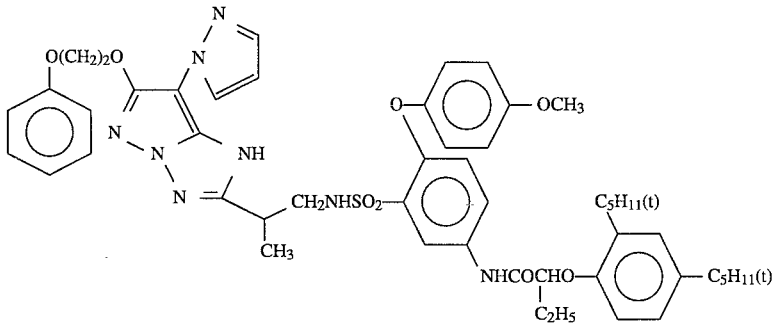
ExM-5
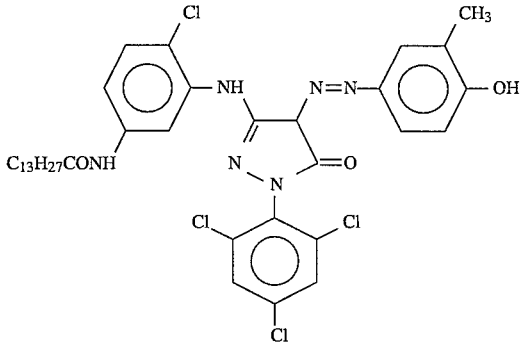
ExM-6
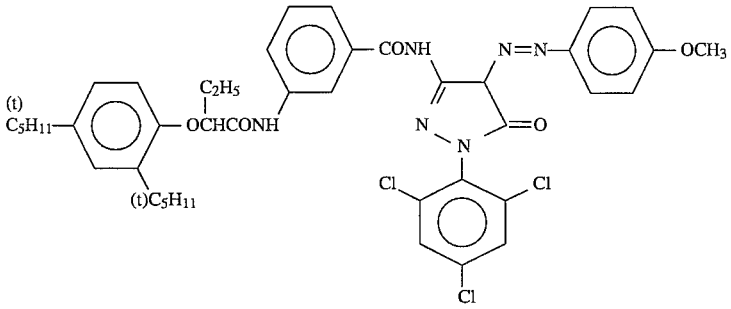
ExY-1
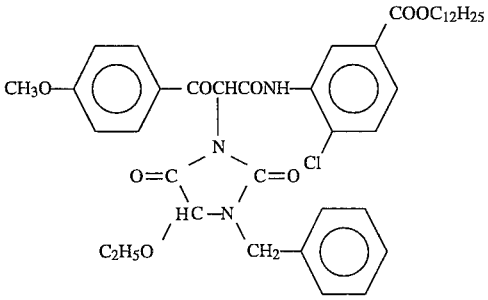
ExY-2
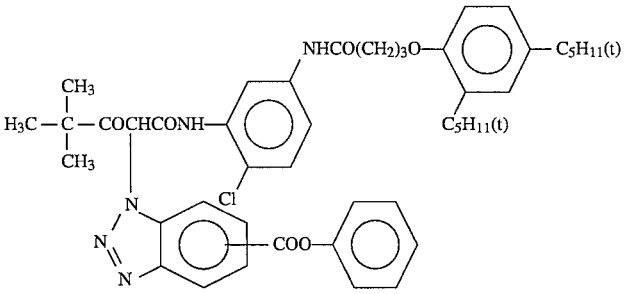

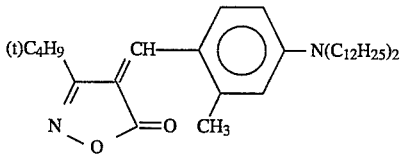
-continued
Cpd-1
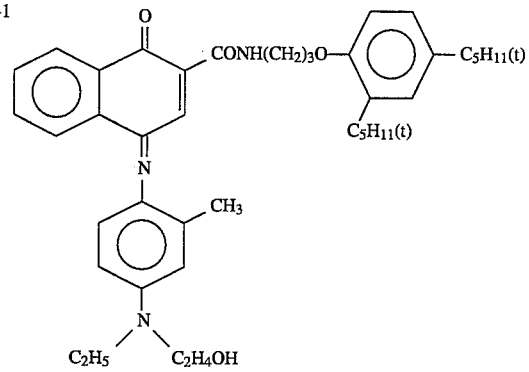
Cpd-2
Cpd-3
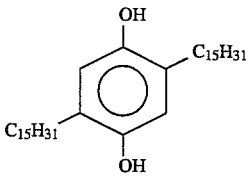
Cpd-4
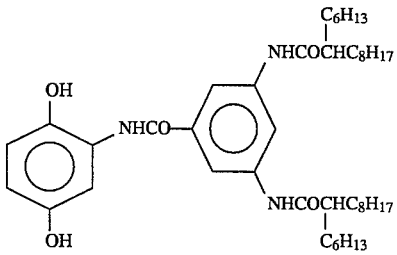
Cpd-5
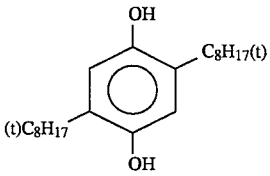
Cpd-6
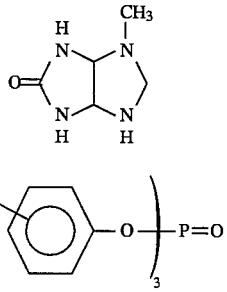
HBS-1
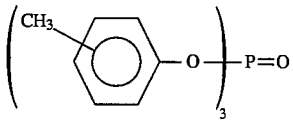
HBS-2
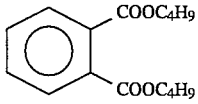
HBS-3
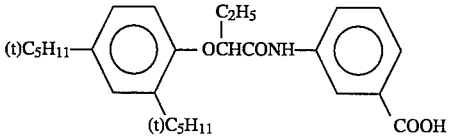
ExS-1
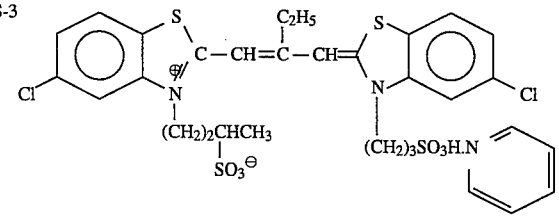
ExS-2
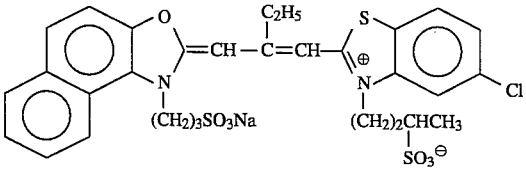
ExS-3
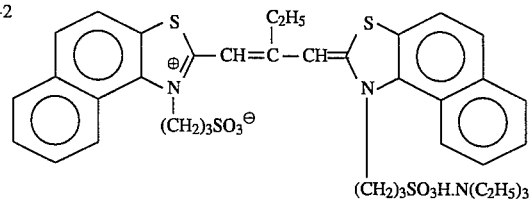

-continued
ExS-4
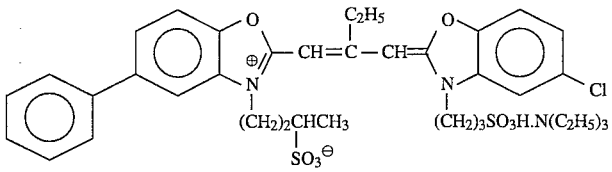
ExS-5
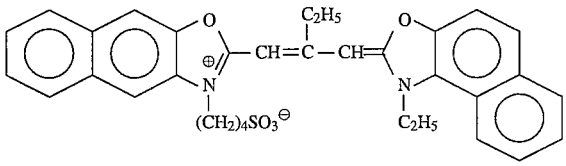
ExS-6
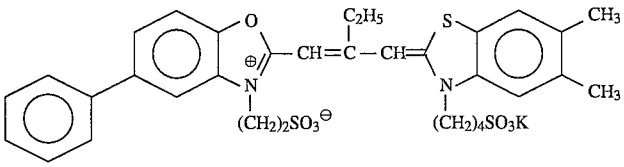
ExS-7
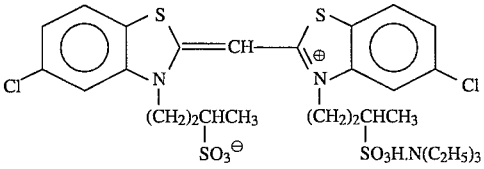
ExS-8
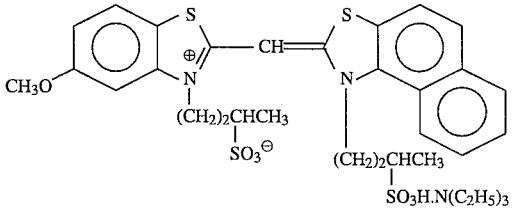
B-1
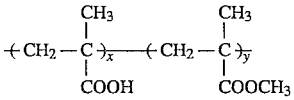
x/y = 10/90
B-2
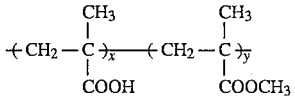
x/y = 40/60
B-3
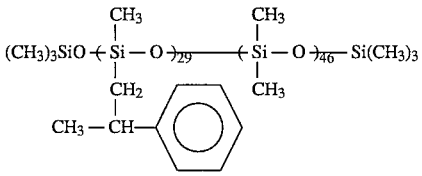
B-4
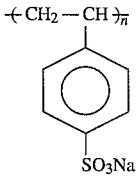
B-5
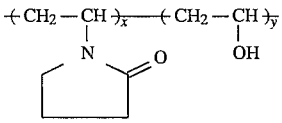
x/y = 70/30
B-6
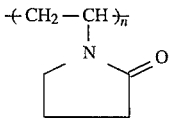
(molecular weight: about 10,000)
W-1
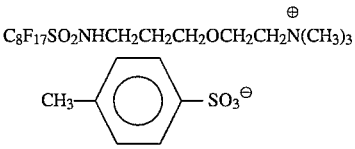
W-2
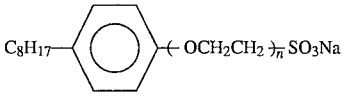
n = 2~4
W-3
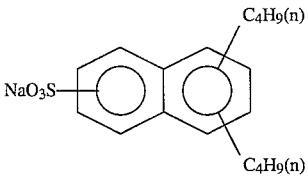
H-1
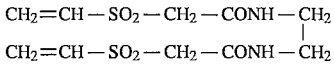

-continued

F-1

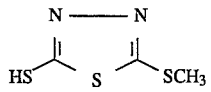

F-2

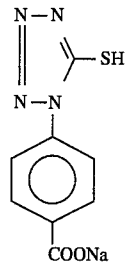

F-3

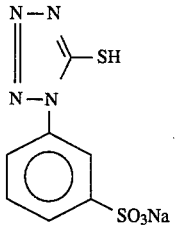

F-4

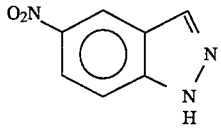

F-5

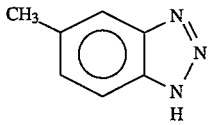

F-6

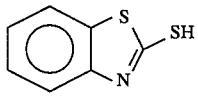

F-7

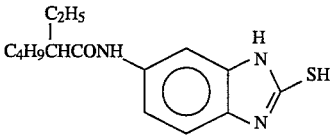

F-8

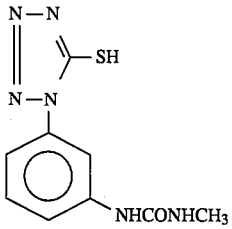

F-9

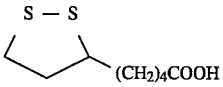

F-10

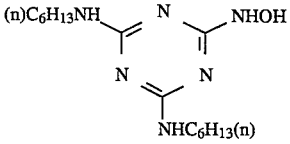

F-11

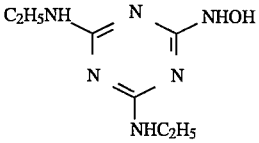

F-12

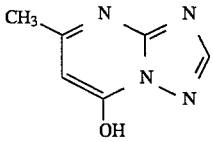

F-13

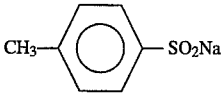

F-14

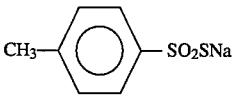

F-15

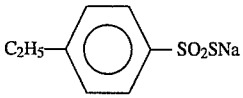

Samples 102 to 104

Samples 102 to 104 were prepared in the same manner as the preparation of Sample 101 except that the yellow colloidal silver contained in the eleventh layer of Sample 101 was removed and dye dispersions SB-1 to SB-3 of the present invention were added such that the addition amount became 0.20 g/m$^2$.

Sample 105

Sample 105 was prepared in the same manner as the preparation of Sample 102 except that the black colloidal silver contained in the first layer of Sample 102 was replaced by dye dispersion SB-4 such that a total addition amount of the dyes became 0.24 g/m$^2$.

The contents of Samples 101 to 105 are shown in Table 2 below.

TABLE 2

| Sample No. | Additives to the First Layer | Additives to the Eleventh Layer |
|---|---|---|
| 101 | Black colloidal silver | Yellow colloidal silver |
| 102 | Black colloidal silver | II-1 |
| 103 | Black colloidal silver | III-12 |
| 104 | Black colloidal silver | IV-7 |
| 105 | III-6/II-2 | II-1 |

The preparation methods of the dye dispersions which were used in the present invention are described below.

Preparation Method of Fine Powder Dye Dispersion SB-1

Dye was dispersed by means of a vibrating ball mill in the following manner.

21.7 ml of water, 3 ml of a 5% aqueous solution of sodium p-octylphenoxyethoxyethanesulfonate, and 0.5 g of a 5% aqueous solution of p-octylphenoxypolyoxyethylene ether (polymerization degree: 10) were placed in a ball mill having a capacity of 700 ml, and 1.00 g of the dye (II-1) of the present invention and 500 ml of zirconium oxide beads (diameter: 1 mm) were added thereto and the content was dispersed for 2 hours. The vibrating ball mill which was used was BO type ball mill manufactured by Chuo Kakoki.

The content was taken out and added to 8 g of a 12.5% aqueous gelatin solution and filtrated beads and the gelatin dispersion of the dye was obtained.

Dispersions SB-2 (dye III-12) and SB-3 (dye IV-7) were obtained by the same manner.

SB-4 was prepared similarly by mixing dyes III-6 and II-2 in a weight ratio of 1:1.

The thus-prepared multilayer color photographic material Samples 101 to 107 were cut in a width of 35 mm, processed, imagewise exposed, and continuously processed (until the total bleaching solution replenisher reached three times the tank capacity) according to the following processing step using automatic processor FP-560B manufactured by Fuji Photo Film Co., Ltd. (the processor was modified so that all the over-flow solution of the bleaching bath was discharged into the waste solution tank, not flowing to the next bath).

The processing steps and the compositions of the processing solutions are shown below.

| Step | Processing Time | Processing Temperature (°C.) | Replenishment Rate* (ml) | Tank Capacity (liter) |
|---|---|---|---|---|
| | Processing Step | | | |
| Color Developing | 3 min 5 sec | 37.6 | 15 | 17 |
| Bleaching | 50 sec | 38.0 | 5 | 5 |
| Fixing (1) | 50 sec | 38.0 | — | 5 |
| Fixing (2) | 50 sec | 38.0 | 5 | 5 |
| Washing | 30 sec | 38.0 | 12 | 3.5 |
| Stabilizing (1) | 20 sec | 38.0 | — | 3 |
| Stabilizing (2) | 20 sec | 38.0 | 15 | 3 |
| Drying | 1 min 30 sec | 60 | | |

*Replenishment rate is an amount per 1.1 meter of 35 mm wide photographic material
(corresponding to one roll film having 24 exposure flames)

Stabilizing and fixing were conducted in a countercurrent system from (2) to (1), and the over-flow from the washing tank was all introduced into the fixing tank (2). Further, an amount of carry-over of the developing solution into the bleaching step, an amount of carry-over of the bleaching solution to the fixing step, and an amount of carry-over of the fixing solution to the washing step were 2.5 ml, 2.0 ml, and 2.0 ml, respectively per 1.1 meter of 35 mm wide photographic material. Further, the crossover time was 6 seconds in each step, which is added to the processing time of the previous step.

The opening areas of the above processor were 120 $cm^2$ in the color developing tank, 120 $cm^2$ in the bleaching tank, and about 100 $cm^2$ in other processing tanks.

The composition of each processing solution is described below.

| | Tank Solution (g) | Replenisher (g) |
|---|---|---|
| Color Developing Solution | | |
| Diethylenetriaminepentaacetic Acid | 2.2 | 2.2 |
| Disodium Catechol-3,5-disulfonate | 0.3 | 0.3 |
| 1-Hydroxyethylidene-1,1-diphosphonic Acid | 2.0 | 2.0 |
| Sodium Sulfite | 3.9 | 5.5 |
| Potassium Carbonate | 37.5 | 39.0 |
| N,N-bis(2-sulfoethyl)hydroxylamine. Disodium | 2.0 | 2.0 |
| Potassium Bromide | 1.4 | — |
| Potassium Iodide | 1.3 mg | — |
| Hydroxylamine Sulfate | 2.4 | 3.6 |
| 2-Methyl-4-(N-ethyl-N-(β-hydroxyethyl)amino)anilino sulfate | 4.5 | 6.8 |
| Water to make | 1.0 l | 1.0 l |
| pH (adjusted with potassium hydroxide and sulfric acid) | 10.05 | 10.21 |
| Bleaching Solution | | |
| 1,3-Diaminopropanetetraacetic Acid Ferric Ammonium Monohydrate | 113 | 170 |
| Ammonium Bromide | 70 | 105 |
| Ammonium Nitrate | 14 | 21 |
| Glutaric Acid | 93 | 140 |
| Water to make | 1.0 l | 1.0 l |
| pH (adjusted with aqueous ammonia) | 4.6 | 4.2 |

| | Tank Solution (g) | Replenisher (g) |
|---|---|---|
| Fixing Solution | | |
| Ammonium Sulfite | 19 | 57 |
| Aqueous Ammonium Thiosulfate Solution (700 g/liter) | 280 ml | 840 ml |
| Imidazole | 15 | 45 |
| Fixing Accelerator (shown in Table A) | 0.3 mol | 0.9 mol |
| Ethylenediaminetetraacetic Acid | 15 | 45 |
| Water to make | 1.0 l | 1.0 l |
| pH (adjusted with aqueous ammonia and acetic acid) | 7.4 | 7.45 |

City water was passed through a mixed bed column packed with an H-type strongly acidic cation exchange resin (Amberlite IR-120B of Roban & Haas) and an OH-type strongly basic anion exchange resin (Amberlite IR-400 of Rohm & Haas) to treat so as to reduce the calcium ion and magnesium ion concentrations to 3 mg/liter or less, subsequently 20 mg/liter of sodium isocyanurate dichloride and 150 mg/liter of sodium sulfate were added thereto. A pH of this washing water was in the range of from 6.5 to 7.5.

| Stabilizing Solution (tank solution equals replenisher) | |
|---|---|
| | (unit: g) |
| Sodium p-Toluenesulfinate | 0.03 |
| Polyoxyethylene-p-monononylphenyl Ether (average polymerization degree: 10) | 0.2 |
| 1,2-Benzisothiazolin-3-one | 0.05 |
| Disodium Ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 1 |
| pH | 8.5 |

Samples 101 to 105 which had not been subjected to exposure were processed after completion of each running processing, and the fixing ability and cyan stain were evaluated. The evaluation method is shown below.

Fixing Ability

The residual silver amount on the unexposed area of the processed sample was measured using a fluorescent X-ray spectroscopic method.

Cyan Stain

Cyan Stain=(cyan minimum density of the sample at the time of finishing of running processing)−(cyan minimum density of the sample before starting running processing)

The results obtained are shown in Table A.

TABLE A

| Fixing Accelerator | Fixing Ability (μg/cm²)/Cyan Stain — Sample No. 101 | 102 | 103 | 104 | 105 |
|---|---|---|---|---|---|
| None (Comparison) | 78/0.18 | 40/0.16 | 40/0.16 | 40/0.16 | 38/0.16 |
| Ammonium Thiocyanate (Comparison) | 65/0.15 | 33/0.12 | 33/0.12 | 33/0.12 | 31/0.12 |
| Compound 1 (Invention) | 62/0.18 | 5/0.02 | 5/0.02 | 5/0.02 | 2/0.01 |
| Compound 4 (Invention) | 62/0.18 | 5/0.02 | 5/0.02 | 5/0.02 | 2/0.01 |
| Compound 16 (Invention) | 64/0.18 | 5/0.02 | 5/0.02 | 5/0.02 | 2/0.01 |
| Compound 19 (Invention) | 64/0.18 | 6/0.02 | 6/0.02 | 6/0.02 | 3/0.01 |
| Compound 31 (Invention) | 66/0.18 | 7/0.04 | 7/0.04 | 7/0.04 | 4/0.02 |
| | Comparison | Invention | Invention | Invention | Invention |

Those enclosed with the square are within the embodiment of the present invention As is apparent from Table A, when samples containing solid fine grain dispersion of dyes according to the present invention were processed with the processing solutions containing fixing accelerators of the present invention, both of the fixing ability and cyan stain were excellent.

EXAMPLE 2

The fixing ability and cyan stain were evaluated in the same manner as in Example 1 except that the concentrations of ammonium ion and sodium ion of the fixing solutions used in Example 1 were changed in ratios as shown in Table B. The results obtained are also shown in Table B.

TABLE B

| Fixing | Fixing Ability (μg/cm²)/Cyan Stain | | | | | |
|---|---|---|---|---|---|---|
| | Sample 101 | | | Sample 105 | | |
| | Ratio of Ammonium Concentrate, (%) | | | | | |
| Accelerator | 100 | 50 | 0 | 100 | 50 | 0 |
| None (Comparison) | 78/0.18 | 83/0.23 | 99/0.30 | 38/0.16 | 42/0.20 | 51/0.26 |
| Thiocyanic Acid (Comparison) | 65/0.15 | 70/0.20 | 86/0.27 | 31/0.12 | 35/0.17 | 44/0.24 |
| Compound 2 (Invention) | 62/0.18 | 67/0.23 | 83/0.30 | 2/0.01 | 3/0.02 | 5/0.03 |
| Compound 5 (Invention) | 62/0.18 | 67/0.23 | 83/0.30 | 2/0.01 | 3/0.02 | 5/0.03 |
| Compound 11 (Invention) | 64/0.18 | 69/0.23 | 85/0.30 | 3/0.01 | 4/0.02 | 6/0.03 |
| Compound 32 (Invention) | 66/0.18 | 71/0.23 | 87/0.30 | 4/0.02 | 5/0.03 | 7/0.04 |
| | Comparison | Comparison | Comparison | Invention | Invention | Invention |

Those enclosed with the square are within the embodiment of the present invention As is apparent from the results in Table B, only the present invention demonstrated conspicuous effect, and the lower the ammonium concentration ratio, the more remarkable the effect becomes.

EXAMPLE 3

The processing was carried out in the same manner as disclosed in Example 1 except for changing the processing step and the processing solution compositions as shown below.

| Step | Processing Step | | | |
|---|---|---|---|---|
| | Processing Time | Processing Temperature (°C.) | Replenishment Rate* (ml) | Tank Capacity (liter) |
| Color Developing | 3 min 15 sec | 37.6 | 15 | 15 |
| Bleaching | 50 sec | 38.0 | 5 | 5 |
| Fixing (1) | 60 sec | 38.0 | — | 5 |
| Fixing (2) | 60 sec | 38.0 | 20 | 5 |
| Stabilizing (1) | 20 sec | 38.0 | — | 3 |
| Stabilizing (2) | 20 sec | 38.0 | — | 3 |
| Stabilizing (3) | 20 sec | 38.0 | 15 | 3 |
| Drying | 1 min 30 sec | 60 | | |

*Replenishment rate is an amount per 1.1 meter of 35 mm wide photographic material
(corresponding to one roll film having 24 exposure flames)

Fixing was conducted in a countercurrent system from (2) to (1), and stabilization was conducted in a countercurrent system from (3) to (2) , from (2) to (1). Further, an amount of carry-over of the color developing solution into the bleaching step, the amount of carry-over of the bleaching solution to the fixing step, and an amount of carry-over of the fixing solution to the stabilizing step were 2.5 ml, 2.0 ml, and 2.0 ml, per 1.1 meter of 35 mm wide photographic material, respectively. Further, the crossover time was 6 seconds in each step, which is added to the processing time of the previous step.

The opening areas of the above processor were 100 cm² in the color developing tank, 120 cm² in the bleaching tank, and about 100 cm² in other processing tanks.

The composition of each processing solution is described below.

Color Developing Solution

The color developing solution is the same as used in Example 1.

Bleaching Solution

The same bleaching solution is the same as used in Example 1.

Fixing (1) Tank Solution

The mixed solution of 10/90 mixture (volume ratio) of the above bleaching tank solution and the following fixing tank solution (pH:7.0)

Fixing Solution

The fixing solutions is the same as used in Example 1, except that the concentrations of ammonium ion and sodium ion were changed to in ratios as shown in Table C, and that fixing accelerators were changed as described in Table C.

| Stabilizing Solution (tank solution equals replenisher) | |
|---|---|
| | (unit: g) |
| Sodium p-Toluenesulfinate | 0.03 |
| Polyoxyethylene-p-monononylphenyl Ether (average polymerization degree: 10) | 0.2 |
| 1,2-Benzisothiazolin-3-one.NaOH | 0.06 |
| Disodium Ethylenediaminetetraacetate | 0.05 |
| 1,2,4-Triazole | 1.3 |
| Image Stabilizer (shown in Table C) | $5 \times 10^{-3}$ mol |
| Glycolic Acid | 0.10 |
| Water to make | 1.0 |
| pH (adjusted with NaOH and glycolic acid) | 8.5 |

Cyan stain and generation of precipitates were evaluated after the termination of the continuous processing. The method for evaluation are shown below.

Cyan Stain

Same as in Example 1.

Generation of Precipitates

After the termination of the continuous processing, each solution of the stabilizing processing step (1) was allowed to stand for 2 weeks in the tank having the same capacity and the same open ratio as the tank of the automatic processor, and the generation of precipitates was visually evaluated.

Evaluation:

o: Precipitates were not observed.

Δ: Precipitates were slightly observed.

x: Precipitates were observed.

xx: A large amount of precipitates were observed.

The results are shown in Table C below.

TABLE C

| Fixing | Cyan Stain (upper row)/Observation of Precipitates (lower row) | | | | | | | | | | | |
|---|---|---|---|---|---|---|---|---|---|---|---|---|
| | Dye Image Stabilizer | | | | | | | | | | | |
| | Formaldehyde | | | Hexamethylenetetramine | | | o-Hydroxybenzaldehyde | | | Compound A* | | |
| | Ratio of Ammonium Concentration (%) | | | | | | | | | | | |
| Accelerator | 100 | 50 | 0 | 100 | 50 | 0 | 100 | 50 | 0 | 100 | 50 | 0 |
| None (Comparison) | 0.18/ xx | 0.22/ xx | 0.29/ xx | 0.17/ x | 0.21/ x | 0.28/ x | 0.17 x | 0.21/ x | 0.28/ x | 0.17 x | 0.21/ x | 0.28/ x |
| Compound 2 (Invention) | 0.03/ Δ | 0.04/ Δ | 0.05/ Δ | 0.02/ o | 0.03/ o | 0.04 o | 0.02/ o | 0.03/ o | 0.04/ o | 0.02/ o | 0.03/ o | 0.04/ o |
| Compound 5 (Invention) | 0.03/ Δ | 0.04/ Δ | 0.05/ Δ | 0.02/ o | 0.03/ o | 0.04/ o | 0.02/ o | 0.03/ o | 0.04/ o | 0.02/ o | 0.03/ o | 0.04/ o |
| Compound 9 (Invention) | 0.03/ Δ | 0.04/ Δ | 0.05/ Δ | 0.02/ o | 0.03/ o | 0.04/ o | 0.02/ o | 0.03/ o | 0.04/ o | 6.02 o | 0.03/ o | 0.04/ o |
| Compound 18 (Invention) | 0.03/ Δ | 0.04/ Δ | 0.05/ Δ | 0.02/ o | 0.03 o | 0.04/ o | 0.02// o | 0.03/ o | 0.04/ o | 0.02/ o | 0.03/ o | 0.04/ o |

Compound A: 1,4-Bis(1,2,4-triazol-1-ylmethyl)piperazine

Excellent preventing effects in not only the cyan stain increase but also the observation of precipitates could be obtained by processing with the stabilizing solution even without water washing. In particular, better effects could be obtained when-the ammonium ion concentration of the fixing solution is low.

EXAMPLE 4

Sample 101 in Example 1 of JP-A-2-854 was prepared and this was denated as Sample 401. Sample 401 was modified as shown below to make Samples 402 to 405.

Samples 402 to 404:

Samples 402 to 404 were prepared in the same manner as in the preparation of Sample 401 except that the yellow colloidal silver used in the eleventh yellow filter layer of Sample 401 was replaced with the dye dispersions SB-5 to SB-7 of the present invention such that a addition amounts of the dyes became 0.25 g/m$^2$.

Sample 405:

Sample 405 was prepared in the same manner as preparing Sample 402 except that the black colloidal silver used in the first layer of Sample 402 was replaced with the dye dispersion SB-8 such that a total addition amount of the dye became 0.30 g/m$^2$.

The additives of the above Samples 401 to 405 are shown in Table 3 below.

TABLE 3

| Sample No. | Additives to the First Layer | Additives to the Eleventh Layer |
|---|---|---|
| 401 | Black colloidal silver | Yellow colloidal silver |
| 402 | Black colloidal silver | II-25 |
| 403 | Black colloidal silver | III-1 |
| 404 | Black colloidal silver | III-5 |
| 405 | III-6/III-4 | II-25 |

The preparing method of the dye dispersions which are used in the present invention is described below.

Preparation Method of Fine Powder Dye Dispersion SB-5

Dye was dispersed by means of a vibrating ball mill in the following manner.

21.7 ml of water, 3 ml of a 5% aqueous solution of sodium p-octylphenoxyethoxyethanesulfonate, and 0.5 g of a 5% aqueous solution of p-octylphenoxypolyoxyethylene ether (polymerization degree:10) were placed in a ball mill having a capacity of 700 ml, and 1.00 g of the dye (II-25) of the present invention and 500 ml of zirconium oxide beads (diameter:1 mm) were added thereto and the mixture was dispersed for 2 hours. The vibrating ball mill which was used was BO type ball mill manufactured by Chuo Kakoki.

The content which was taken out added to 8 g of a 12.5% aqueous gelatin solution followed treating beads to obtain a gelatin dispersion of the dye.

Dispersions SB-6 (dye III-1) and SB-7 (dye III-5) were obtained by the same manner.

SB-8 was prepared similarly by mixing dyes III-6 and III-4 in a weight ratio of 1:1.

The thus-prepared multilayer color photographic material Samples 401 to 405 were cut in a width of 35 mm, processed, imagewisely exposed, and continuously processed (until the total bleaching replenisher amount reached to three times the tank capacity) according to the following processing step using an automatic processor.

| Processing Step | | | | |
|---|---|---|---|---|
| Step | Processing Time | Processing Temperature (°C.) | Tank Capacity (liter) | Replenishment Rate (ml/m$^2$) |
| First Developing | 4 min | 38 | 12 | 1,000 |
| First Washing | 45 sec | 38 | 2 | 2,200 |
| Reversal | 45 sec | 38 | 2 | 500 |
| Color Development | 4 min | 38 | 12 | 1,000 |
| Bleaching | 3 min | 38 | 4 | 200 |
| Fixing | 3 min | 38 | 8 | 500 |
| Second Washing (1) | 1 min | 38 | 2 | — |
| Second | 1 min | 38 | 2 | 1,100 |

-continued

| Step | Processing Time | Processing Temperature (°C.) | Tank Capacity (liter) | Replenishment Rate (ml/m²) |
|---|---|---|---|---|
| | Processing Step | | | |
| Washing (2) | | | | |
| Stabilizing | 1 min | 25 | 2 | 500 |
| Drying | 1 min | 65 | — | — |

Second washing was conducted in a countercurrent system by introducing the replenisher into second washing (2) and the over-flow from second washing (2) was introduced into second washing (1) .

The composition of each processing solution is described below.

| | Tank Solution | Replenisher |
|---|---|---|
| First Developing Solution | | |
| Nitrilo-N,N,N-trimethylene-phosphonic Acid.Pentasodium Salt | 2.0 g | 3.0 g |
| Sodium Sulfite | 30 g | 40 g |
| Hydroquinone-Potassium Monosulfonate | 30 g | 40 g |
| Potassium Carbonate | 40 g | 48 g |
| 1-Phenyl-4-methyl-4-hydroxymethyl-3-pyrazolidone | 2.0 g | 3.5 g |
| Potassium Bromide | 2.5 g | 0 g |
| Potassium Thiocyanate | 1.2 g | 1.8 g |
| Potassium Iodide | 2.0 mg | — |
| Water to make | 1,000 ml | 1,000 ml |
| pH (adjusted with sulfuric acid or potassium hydroxide) | 10.00 | 10.20 |
| First Washing Water | | |
| Ethylenediaminetetramethylene-phosphonic Acid | 2.0 g | Replenisher equals tank solution |
| Disodium Phosphate | 5.0 g | |
| Water to make | 1,000 ml | |
| pH (adjusted with hydrochloric acid or sodium hydroxide) | 7.00 | |
| Reversal Solution | | |
| Nitrilo-N,N,N-trimethylene-phosphonic Acid.Pentasodium Salt | 3.0 g | Replenisher equals tank solution |
| Stannous Chloride.Dihydrate | 1.0 g | |
| p-Aminophenol | 0.1 g | |
| Sodium Hydroxide | 8 g | |
| Glacial Acetic Acid | 15 ml | |
| Water to make | 1,000 ml | |
| pH (adjusted with acetic acid or sodium hydroxide) | 6.00 | |
| Color Developing Solution | | |
| Nitrilo-N,N,N-trimethylene-phosphonic Acid.Pentasodium Salt | 2.0 g | 3.0 g |
| Sodium Sulfite | 7.0 g | 10.0 g |
| Trisodium Phosphate.Dodecahydrate | 40 g | 45 g |
| Potassium Bromide | 1.0 g | — |
| Potassium Iodide | 90 mg | — |
| Sodium Hydroxide | 3.0 g | 3.0 g |
| Citrazinic Acid | 1.5 g | 1.5 g |
| N-Ethyl-N-(β-methanesulfonamidoethyl)-3-methyl-4-aminoaniline-3/2 Sulfuric Acid.Monohydrate | 15 g | 20 g |
| 3,6-Dithiaoctane-1,8-diol | 1.0 g | 1.2 g |
| Water to make | 1,000 ml | 1,000 ml |
| pH (adjusted with sulfuric acid or potassium hydroxide) | 12.00 | 12.20 |
| Bleaching Solution | | |
| 1,3-Diaminopropanetetraacetic Acid Ferric Ammonium.Monohydrate | 50 g | 100 g |
| Potassium Bromide | 100 g | 200 g |
| Ammonium Nitrate | 10 g | 20 g |
| Acetic Acid (90%) | 60 g | 120 g |
| 3-Mercapto-1,2,4-triazole | 0.0005 mol | 0.0008 mol |
| Water to make | 1,000 ml | 1,000 ml |
| pH (adjusted with nitric acid or aqueous ammonia) | 4.5 | 4.0 |
| Fixing Solution | | |
| Ethylenediaminetetraacetic Acid-Disodium Salt.Dihydrate | 10.0 g | 15.0 g |
| Sodium Thiosulfate | 150 g | 200 g |
| Sodium Sulfite | 25.0 g | 30.0 g |
| Fixing Accelerator (described in Table D) | 0.5 mol | 0.7 mol |
| Water to make | 1,000 ml | 1,000 ml |
| pH (adjusted with acetic acid or aqueous ammonia) | 6.60 | 6.80 |

Second Washing Water

City water was passed through a mixed bed column packed with an H-type strongly acidic cation exchange resin (Amberlite IR-120B of Rohm & Haas) and an OH-type anion exchange resin (Amberlite IR-400 of Rohm & Haas) to reduce calcium ion and magnesium ion concentrations to 3 mg/liter or less, and subsequently 20 mg/liter of sodium isocyanurate dichloride and 1.5 g/liter of sodium sulfate were added thereto. A pH of this washing water was in the range of from 6.5 to 7.5.

| Stabilizing Solution | Tank Solution | Replenisher |
|---|---|---|
| 1-Hydroxymethyl-1,2,4-triazole | 2.3 g | Replenisher equals tank solution |
| Polyoxyethylene-p-monononylphenyl Ether (average polymerization degree: 10) | 0.3 g | |
| 1,2,4-Triazole | 2.0 g | |
| 1,4-Bis(1,2,4-triazol-1-ylmethyl)-piperazine | 0.2 g | |
| 1,2-Benzisothiazolin-3-one | 0.05 g | |
| Water to make | 1,000 ml | |
| pH (adjusted with sodium hydroxide and acetic acid) | 6.5 | |

The fixing ability and cyan stain were evaluated in the same manner as in Example 1 after completion of each running processing. The results obtained are shown in Table D.

TABLE D

| Fixing Accelerator | Fixing Ability (μg/cm²)/Cyan Stain Sample No. 401 | 402 | 403 | 404 | 405 |
|---|---|---|---|---|---|
| None (Comparison) | 72/0.16 | 37/0.19 | 37/0.19 | 37/0.19 | 35/0.19 |
| Sodium Thiocyanate (Comparison) | 48/0.19 | 25/0.20 | 25/0.20 | 25/0.20 | 23/0.20 |
| Compound 2 (Invention) | 46/0.17 | 5/0.02 | 5/0.02 | 5/0.02 | 2/0.01 |
| Compound 4 (Invention) | 46/0.17 | 5/0.02 | 5/0.02 | 5/0.02 | 2/0.01 |
| Compound 16 (Invention) | 48/0.18 | 5/0.02 | 5/0.02 | 5/0.02 | 2/0.01 |
| Compound 19 (Invention) | 48/0.18 | 6/0.03 | 6/0.03 | 6/0.03 | 3/0.01 |
| Compound 32 (Invention) | 49/0.19 | 7/0.04 | 7/0.04 | 7/0.04 | 4/0.02 |
| | Comparison | Invention | Invention | Invention | Invention |

Those enclosed with the square are within the embodiment of the present invention As is apparent from Table D, when reversal photographic materials which contained solid fine dye grain dispersions were processed with the processing solutions containing fixing accelerators of the present invention, both of the fixing ability and cyan stain were excellent.

EXAMPLE 5

Samples were prepared in the same manner as in Example 1 except for modifying the support used in Example 1 as described below, and evaluated in the same manner as in Example 1. The results obtained were in the same level as those in Example 1.

(1) Material of the Support.

Each of the supports used in the example was prepared in the following method.

PEN: 100 Weight parts of commercially available poly-(ethylene-2,6-naphthalate) polymer and 2 weight parts of Tinuvin P. 326 (product of Geigy), as an ultraviolet absorber, were dried in a usual method, then, melted at 300° C., subsequently, extruded through a T-type die, and stretched 3.3 times in a lengthwise direction at 140° C. and then 3.3 times in a width direction at 130° C., and further thermally stabilized for 6 seconds at 250° C.

(2) Coating a Subbing Layer

A subbing layer having the following composition was coated on the above support after both surfaces of which were corona discharged. The subbing layer was provided on the hotter side at the time of stretching. The corona discharge treatment was carried out using solid state corona processor model 6 KVA available from Pillar Co., Ltd. which can treat the support of 30 cm wide at a rate of 20 m/min. At that time, the treatment of 0.375 KV.A.min/m² was conducted to the support from the reading of the voltage and electric current. The discharge frequency at the treatment time was 9.6 KHz, gap clearance between the electrode and the induction roll was 1.6 mm.

| | |
|---|---|
| Gelatin | 3 g |
| Distilled Water | 250 cc |
| Sodium-α-sulfodi-2-ethylhexyl-succinate | 0.05 g |
| Formaldehyde | 0.02 g |

(3) Coating a Backing Layer

A backing layer having the following composition was coated on the opposite side of the support to the side having a subbing layer.

(3-1) Preparation of Electrically Conductive Fine Grain Dispersion Solution (a composite dispersion solution of stannic oxide-antimony oxide)

230 weight parts of stannic chloride hydrate and 23 weight parts of antimony trichloride were dissolved in 3,000 weight parts of ethanol to form homogeneous solution. A 1N aqueous sodium hydroxide solution was dropwisely added to the above solution until a pH of the solution reached 3, thereby coprecipitating colloidal stannic oxide and antimony oxide. The thus-obtained coprecipitate was allowed to stand at 50° C. for 24 hours to form reddish brown colloidal precipitate.

The reddish brown colloidal precipitate was isolated by a centrifugal separator. Water was added to the precipitate and washed by centrifugation to remove excessive ion. The excessive ion was removed by repeating the operation three times.

200 weight parts of the colloidal precipitate from which the excessive ion was removed was again dispersed in 1,500 weight parts of water, atomized into a furnece heated to 600° C., thereby forming a bluish fine grain powder a composite of stannic oxide-antimony oxide, having an average grain size of 0.1 μm. The resistivity of the fine grain powder was 25 Ω.cm.

A pH of the mixed solution comprising 40 weight parts of the above fine grain powder and 60 weight parts of water was adjusted to 7.0. The mixed solution was dispersed coarsely by a disperser, then dispersed using a horizontal sand mill (Dyno-Mill, manufactured by WILLYA. BACHOFENAG) until the residence time reached 30 minutes to obtain the product.

(3-2) Preparation of a Backing Layer

The composition (A) described below was coated on the support to form a dry film thickness of 0.3 μm followed by drying at 115° C. for 60 seconds. Further, the coating solution for covering (B) described below was coated on the above composition (A) to form a dry film thickness of 1 μm followed by drying at 115° C. for 3 minutes.

| Composition (A) | |
|---|---|
| The Above Electrically Conductive Fine Grain Dispersion Solution | 10 weight parts |
| Gelatin | 1 weight part |
| Water | 27 weight parts |
| Methanol | 60 weight parts |
| Resorcin | 2 weight parts |
| Polyoxyethylenenonylphenyl Ether | 0.01 weight parts |
| **Coating Solution for Covering (B)** | |
| Cellulose Triacetate | 1 weight part |
| Acetone | 70 weight parts |
| Methanol | 15 weight parts |
| Dichloromethylene | 10 weight parts |
| p-Chlorophenol | 4 weight parts |
| Silica Grain (average size: 0.2 μm) | 0.01 weight parts |
| Polysiloxane | 0.005 weight parts |
| Dispersion of $C_{15}H_{31}COOC_{40}H_{81}$/ $C_{50}H_{101}O(CH_2CH_2O)_{16}H$ (8/2 weight ratio) (average grain size: 20 nm) | 0.1 weight parts |

(4) Heat Treatment of the Support

After the subbing layer and the backing layer were coated according to the above method, the support was dried and wound around a core having a diameter of 30 cm with the subbing layer side outside, and again heat-treated for 24 hours at 110° C.

While the invention has been described in detail and with reference to specific examples thereof, it will be apparent to one skilled in the art that various changes and modifications can be made therein without departing from the spirit and scope thereof.

What is claimed is:

1. A method for processing a silver halide photographic material having at least one hydrophilic colloidal layer containing a dye of a solid fine grain dispersion, which comprises processing the photographic material with a solution having a fixing ability containing at least one compound represented by formula (A):

$$RSO_2SM \quad (A)$$

wherein R represents an aliphatic group, an aryl group or a heterocyclic group, and M represents a hydrogen atom or a cation group.

2. The method for processing a silver halide photographic material as claimed in claim 1, wherein the dye is represented by formula (I):

$$D—(X)_y \quad (I)$$

wherein D represents a compound having a chromophore, X represents a dissociative proton bonded to D directly or via a divalent linking group, or a group having a dissociative proton, and y represents an integer of from 1 to 7.

3. The method for processing a silver halide photographic material as claimed in claim 1 or 2, wherein an ammonium ion concentration in the solution having a fixing ability is from 0 to 50 mol % based on the whole cation.

4. The method for processing a silver halide photographic material as claimed in claim 1, wherein R in the formula (A) represents an aliphatic group or a heterocyclic group.

5. The method for processing a silver halide photographic material as claimed in claim 4, wherein R represents an aliphatic group having 1 to 6 carbon atoms.

6. The method for processing silver halide photographic material as claimed in claim 5, wherein R represents an alkyl group having 1 to 6 carbon atoms.

7. The method for processing a silver halide photographic material as claimed in claim 1, wherein the solution having fixing ability contains at least one compound of formula (A) in an amount of $1\times10^{-3}$ to 5 mol/l of the solution.

8. The method for processing a silver halide photographic material as claimed in claim 1, wherein the solution having a fixing ability contains an imidazole compound.

9. The method for processing a silver halide photographic material as claimed in claim 8, wherein the imidazole compound is an imidazole.

10. The method for processing a silver halide photographic material as claimed in claim 8, wherein the imidazole compound is contained in an amount of 0.01 to 2 mol/l of the solution having fixing ability.

11. The method for processing a silver halide photographic material as claimed in claim 3, wherein the ammonium ion concentration is from 0 to 1 gram ion/l of the solution and an alkali metal ion concentration is from 0.5 to gram ion/l of the solution.

12. The method for processing a silver halide photographic material as claimed in claim 2, wherein the dye of the formula (I) is represented by formulae (II) to (V);

$$A_1{=}L_1{-}(L_2{=}L_3)_m Q \quad (II)$$

$$A_1{=}L_1{-}(L_2{=}L_3)_n A_2 \quad (III)$$

$$A_1{\neq}L_1{-}L_2)_p B_1 \quad (IV)$$

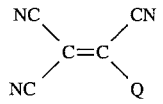

(V)

13. The method for processing a silver halide photographic material as claimed in claim 1, wherein the dye is contained in an amount of from $5\times10^{-2}$ to $5\times10^{-7}$ mol/m$^2$ of the photographic material.

* * * * *